US008913926B2

(12) United States Patent
Nakamura et al.

(10) Patent No.: US 8,913,926 B2
(45) Date of Patent: Dec. 16, 2014

(54) DEVELOPER CONTAINER, DEVELOPING DEVICE, PROCESS CARTRIDGE, IMAGE FORMING DEVICE, AND DEVELOPER REFILLING METHOD

(75) Inventors: Kenji Nakamura, Osaka (JP); Hirobumi Ooyoshi, Kanagawa (JP); Tomofumi Yoshida, Osaka (JP); Manabu Hamada, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 52 days.

(21) Appl. No.: 13/824,549

(22) PCT Filed: Aug. 7, 2012

(86) PCT No.: PCT/JP2012/070583

§ 371 (c)(1),
(2), (4) Date: Mar. 18, 2013

(87) PCT Pub. No.: WO2013/022110

PCT Pub. Date: Feb. 14, 2013

(65) Prior Publication Data

US 2013/0183065 A1 Jul. 18, 2013

(30) Foreign Application Priority Data

Aug. 8, 2011 (JP) ..... 2011-172608
Jan. 20, 2012 (JP) ..... 2012-010244

(51) Int. Cl.
*G03G 15/08* (2006.01)

(52) U.S. Cl.
CPC ..... *G03G 15/0891* (2013.01); *G03G 15/0844* (2013.01)
USPC ..... 399/257; 399/109; 399/258; 399/262

(58) Field of Classification Search
CPC ..... G03G 15/08; G03G 15/0822; G03G 15/0891; G03G 15/0894; G03G 2215/066; G03G 2215/0855
USPC ..... 399/109, 110, 111, 119, 120, 258, 262
See application file for complete search history.

(56) References Cited

U.S. PATENT DOCUMENTS

| | | | | |
|---|---|---|---|---|
| 6,782,221 | B2 * | 8/2004 | Saito et al. | 399/109 |
| 2007/0295363 | A1 | 12/2007 | Fuchigami et al. | 134/22.1 |
| 2008/0031658 | A1 | 2/2008 | Okamoto et al. | 399/262 |
| 2009/0022531 | A1 | 1/2009 | Kubota et al. | 399/359 |
| 2011/0002720 | A1 | 1/2011 | Ooyoshi | 399/359 |

FOREIGN PATENT DOCUMENTS

| | | |
|---|---|---|
| JP | 07-168507 | 7/1995 |
| JP | 08-123297 | 5/1996 |
| JP | 2001-242704 | 9/2001 |

(Continued)

OTHER PUBLICATIONS

International Search Report Issued Oct. 2, 2012 in PCT/JP2012/070583 Filed on Aug. 7, 2012.

*Primary Examiner* — Sophia S Chen
(74) *Attorney, Agent, or Firm* — Oblon, Spivak, McClelland, Maier & Neustadt, L.L.P.

(57) ABSTRACT

A first developer container delivers developer to a second developer container, the first developer container including a first opening to be engaged with the second developer container and to deliver the developer; and a conveyor to convey the developer and to deliver the developer through the first opening.

20 Claims, 23 Drawing Sheets

(56) References Cited

FOREIGN PATENT DOCUMENTS

| | | |
|---|---|---|
| JP | 2001-255730 | 9/2001 |
| JP | 2005-037708 | 2/2005 |
| JP | 2006-085124 | 3/2006 |
| JP | 2007-163922 | 6/2007 |
| JP | 2007-163923 | 6/2007 |
| JP | 2010-128184 | 6/2010 |

* cited by examiner

DEVELOPER CONTAINER, DEVELOPING DEVICE, PROCESS CARTRIDGE, IMAGE FORMING DEVICE, AND DEVELOPER REFILLING METHOD

TECHNICAL FIELD

Embodiments of the present invention relate to a developer container, a developing device, a process cartridge, an image forming device, and a developer refilling method. Further, the embodiments of the present invention relate to a method of collecting developer from a developing device (a developer collecting method for the developing device), which is detachably attached to an image forming device such as a copier, a printer, a facsimile machine, or a compound machine thereof. Especially, the embodiments of the present invention relate to a developer collecting method for a developing device in which a developer container is detachably attached to the developing device main unit.

BACKGROUND ART

In an image forming device to which an electrophotographic method is applied, such as a printer or a copier, an image is formed on a surface of a recording medium through a process in which a developing device develops an electrostatic latent image formed on a photosensitive drum by supplying toner to the electrostatic latent image. As a developing device included in such an image forming device, the following developing devices can be considered. Namely, a developing device to which toner is supplied from the toner cartridge storing the toner and a developing device that consumes the toner stored in the developing device in advance can be considered. Once the toner stored in the toner cartridge is used up, the used toner cartridge is replaced with a new toner cartridge, which is filled with toner. Similarly, once the toner stored in the developing device is used up, the used developing device is replaced with a new developing device filled with toner.

Inside such a used toner cartridge or a used developing device, a considerable amount of developer (toner) is still remaining. From the viewpoint of resource saving, it is preferable that, in addition to the used toner cartridge or the used developer, the residual developer be reused.

For example, Patent Document 1 (Japanese Patent Laid-Open No. 2010-128184) discloses a reproduction method of a developing device such that the used developing device is refilled with developer, and thereby the developer is reproduced. According to the reproduction method of Patent Document 1, a developer can be reproduced by a simple method.

Further, Patent Document 2 (Japanese Patent Laid-Open No. 2005-037708) discloses a cartridge cleaning device. With such a cartridge cleaning device, a cartridge can be reused by efficiently and successfully suctioning and discharging the residual toner by using a dust collector.

Further, a technique has conventionally been known such that, for an image forming device such as a copier or a printer, developer remaining inside a developing device is collected during a recycling process of the developing device (cf. Patent Document 3 (Japanese Patent Laid-Open No. 2001-242704), and Patent Document 4 (Japanese Patent Laid-Open No. 2001-255730)).

Specifically, for example, Patent Document 3 discloses a technique for removing the residual toner such that, in the recycling process of the developing device, the developing roller is rotated in a direction that is opposite to a normal rotational direction, and the toner is removed from a circumferential surface of the developing roller by using a cleaning unit. Here, the circumferential surface is exposed from an opening that is facing a photosensitive drum.

However, in the reproducing method of the developing device according to Patent Document 1, the developer remaining inside the developing device and the developer that is refilled are mixed. When the two types of developer having different use histories are mixed in the developing device, since the charging characteristics of the corresponding types of developer are different from each other, it is possible that an image failure such as density unevenness occurs when a low density image (a gray image) having a large area is formed.

It is possible to prevent such a failure caused by mixing the two types of toner having different use histories by cleaning the cartridge using the cartridge cleaning device according to Patent Document 2. However, in this case, the device for collecting the residual toner may be required, and the cost may be increased.

As it is described, when a developer container for storing developer (toner) is to be reused, it is preferable to ensure a certain level of image quality by preventing a failure caused by mixing two types of toner having different use histories. On the other hand, there are some consumers who allow degradation of the image quality and request recycled products having low prices, even though the image quality is low. Therefore, for such consumers, it is effective to reuse a toner cartridge or a developing device by collecting different types of developer having different use histories and refilling the toner cartridge or the developing device with the mixed toner.

The embodiments of the present invention have been developed in view of the above-described circumstances. An objective of the embodiments of the present invention is to provide a developer container, with which residual toner can be collected without waste and can be reused, and which allows efficient recycling of the residual toner.

Further, with the conventional technique, a non-negligible amount of the developer may remain inside the developing device, even after the developer has been collected. Additionally, with the conventional technique, the developer collected from the developing device may be discarded without being reused. Such failures occur not only in a case where the developing device is reproduced (recycled) at a recycling plant, but also in a case where a new developing device is refilled with developer and an operation check of the developing device is performed at a manufacturing plant, and subsequently the developer is collected from the developing device and the developing device is packaged and shipped.

The embodiments of the present invention have been developed in view of the above problem. Another objective of the embodiments of the present invention is to provide a developer collecting method for a developing device such that developer remaining inside the developing device is effectively collected and the collected developer is reused, without being discarded.

SUMMARY OF THE INVENTION

Means for Solving the Problems

In one aspect, there is provided a first developer container configured to deliver developer to a second developer container. The first developer container includes an opening configured to be connected to the second developer container and configured to deliver the developer, and a conveyor that conveys the developer and causes the toner to be delivered through the opening.

In another aspect, there is provided a developer refilling method including an engaging process of engaging a first developer container with a second developer container, wherein the first developer container includes a first opening configured to be engaged with the second container, and a first conveyor configured to convey developer and configured to deliver the developer through the first opening, and wherein the second developer container includes a second opening configured to be engaged with the first container, and a second conveyor configured to convey the developer and configured to deliver the developer through the second opening, the first container and the second container being engaged with each other by engaging the first opening with the second opening, a first conveyance process, by the first conveyor, of conveying the developer toward the first opening in the first developer container, a second conveyance process, by the second conveyor, of conveying the developer in a direction in which the developer is separated from the second opening in the second developer container, wherein the second developer container is refilled with the developer by delivering the developer from the first developer container to the second developer container through the first opening and the second opening, the first opening and the second being engaged with each other.

In another aspect, there is provided a developer collecting method for a developing device configured to be detachably attached to an image forming device main body.

The developing device includes a developing device main unit configured to develop a latent image formed on an image supporting body; and a developer container configured to be detachably attached to an upper portion of the developing device main unit attached to the image forming device main body, wherein the developer container is configured to store the developer to be supplied to the developing device main unit.

The developing device main unit includes a developer supporting body disposed to face the image supporting body in a state in which the developing device main unit is attached to the image forming device main body and configured to support the developer; plural conveyors configured to convey the developer stored inside the image forming device main unit in a longitudinal direction and configured to form a circulation path in the state in which the developing device main unit is attached to the image forming device main body, the plural conveyors being arranged in parallel in a vertical direction through a partition member; and a main unit side supply port configured to communicate with a container side supply port of the developer container at an upper portion of the developing device main unit in the state in which the developing device main unit is attached to the image forming device main body, wherein the main unit side supply port is configured to supply the developer from the developer container to the developing device main unit.

In the developer collecting method, when the developer remaining inside the developing device main unit being removed from the image forming device main body is collected, the developing device main unit is attached to the developer container in a first arrangement that is different from a second arrangement of the developing device main unit and the developer container in a state in which the developing device main unit and the developer container are attached to the image forming device main body, and the developer is discharged from the developing device main body and collected inside the developer container by driving the plural conveyors similar to a case where the developing device main unit is attached to the image forming device main body.

According to the embodiments, a developer container can be provided such that it realizes efficient recycling. With the developer container, residual toner can be collected and reused, without waste.

Further, according to the embodiments of the present invention, when the developer remaining inside the developing device main unit that is removed from the image forming device main body is collected by arranging plural conveyors, which convey the developer in the longitudinal direction and form the circulation path in the developing device main portion in parallel in the vertical direction through a partition member, the developer may be collected inside the developer container by discharging the developer from the developing device main portion by driving the plural conveyors, while the developer container is attached to the developing device main portion in an arrangement that is different from the arrangement where the developer container is attached to the developing device main portion when the developing device main portion is attached to the image forming device main body. With this, a developer collecting method for the developing device can be provided such that the developer remaining inside the developing device can be effectively collected and the developer collected from the developing device is reused, without being discarded.

DESCRIPTION OF THE REFERENCE NUMERALS

Figure 1:
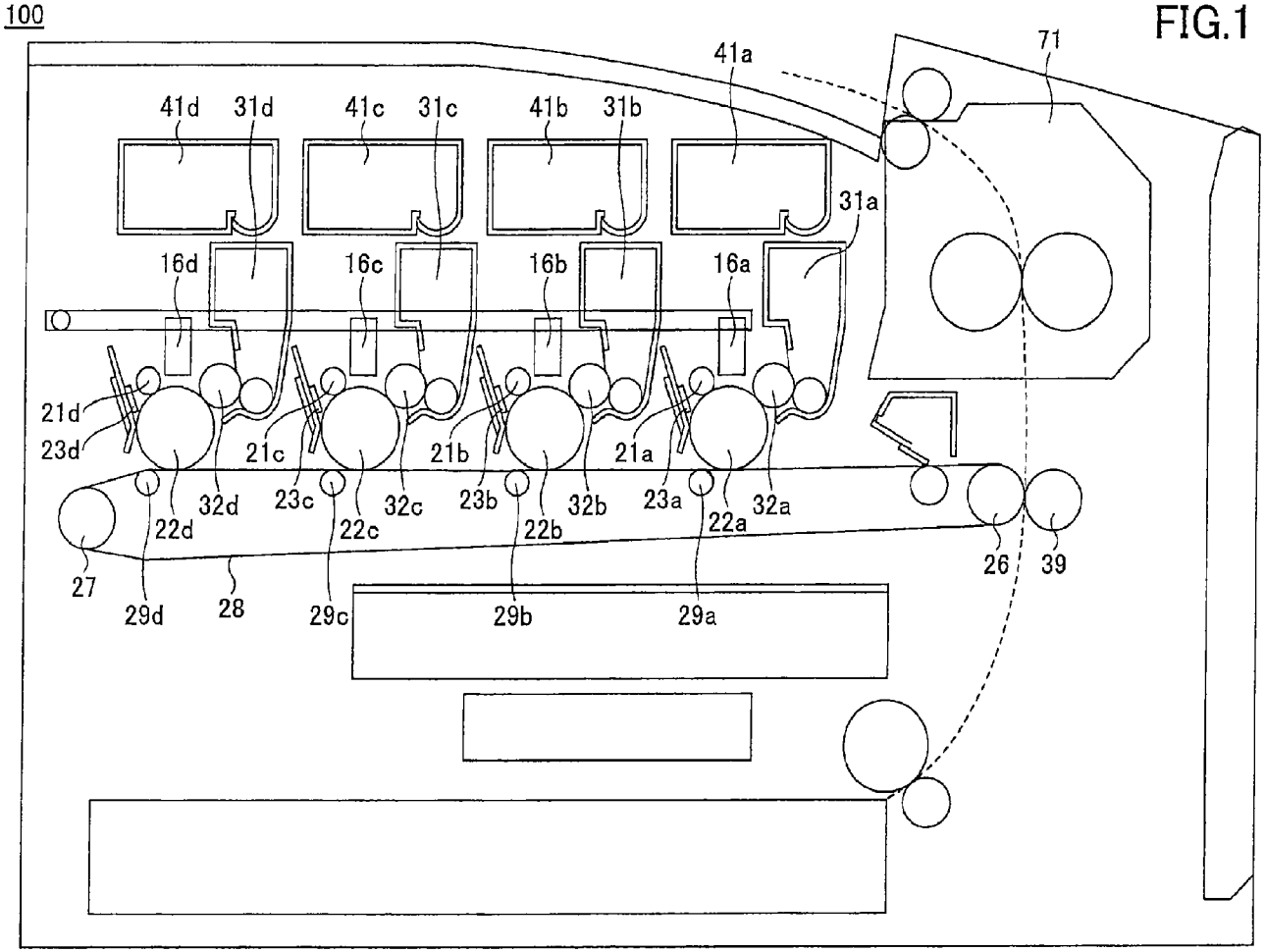
FIG. 1 is a schematic diagram showing an example of a configuration of an image forming device according to a first embodiment.

31 Developing device
34, 51 Conveyance screws (conveyors)
35 Toner housing chamber (developer housing chamber)
36, 54 Openings (first openings)
37, 55 Openings (second openings)
41 Toner cartridge (developer container)
59 Connecting member
100 Image forming device
101 Process cartridge
201Y Photosensitive drum (image supporting body)
202Y Cleaning unit
204Y Charging unit
205Y Developing device
206Y, 206M, 206C, 206K Image forming units
2050 Developing device main unit
2051 Developing roller (developer supporting body)
2052 Doctor blade (developer regulating member)
2053 Supply roller (developer supply member)
2054 First conveyance screw (conveyor)
2055 Second conveyance screw (conveyor)
2056 Partition member
2057 Main unit side supply port
2058, 2059 Main unit side openings
2060 Toner container (developer container)
2062, 2062A, 2062B Container side conveyance screws (container side conveyors)
2063 Container side supply port
2064 Container side opening
2100 Image forming device main body (device main body)

MODE FOR CARRYING OUT THE INVENTION

Hereinafter, embodiments of the present invention are explained by referring to the accompanying figures. In the figures, same reference numerals are attached to portions that have the same configurations, and thereby overlapped explanations may be omitted.

First Embodiment

Configuration of Image Forming Device

FIG. 1 is a schematic view showing an example of a configuration of an image forming device 100 according to a first embodiment.

As shown in FIG. 1, the image forming device 100 is a color image forming device having four image forming units. Each of the image forming units includes a photosensitive body 22, a developing device 31 facing the photosensitive body 22, a toner cartridge 41 as a developer container disposed above the developing device 31.

Around the photosensitive body 22 (photosensitive bodies 22*a*, 22*b*, 22*c*, and 22*d*), a charging roller 21 (charging rollers 21*a*, 21*b*, 21*c*, and 21*d*) for charging a surface of the photosensitive body 22 to have a predetermined electric potential; an exposing device 16 (exposing devices 16*a*, 16*b*, 16*c*, and 16*d*) for forming an electrostatic latent image on the photosensitive body 22, the surface of which is charged; a developing device 31 (developing devices 31*a*, 31*b*, 31*c*, and 31*d*) for supplying toner to the electrostatic latent image; and a cleaning blade 23 (cleaning blades 23*a*, 23*b*, 23*c*, and 23*d*) for removing the toner that remains on the surface of the photosensitive body 22 after transferring of the toner image are disposed.

Further, an intermediate transfer belt 28 that is abutted to and is separated from the photosensitive body 22 is suspended around a driving roller 26, a driven roller 27, and a primary roller (primary rollers 29*a*, 29*b*, 29*c*, and 29*d*) so that the intermediate transfer belt 28 is rotationally driven.

When an image is to be formed, first, the charging roller 21 charges the surface of the photosensitive body 22 to have the predetermined electric potential. Subsequently, the exposing device 16 exposes the charged surface of the photosensitive body 22 based on input image data, thereby forming an electrostatic latent image on the surface of the photosensitive body 22.

When the electrostatic latent image formed on the surface of the photosensitive body 22 passes through a position facing a developing roller 32 (developing rollers 32*a*, 32*b*, 32*c*, and 32*d*), the electric potential difference between the surface of the photosensitive body 22 and the developing device 31, which rotates while supporting the charged toner on its surface, causes the toner to be supplied to the electrostatic latent image, thereby visualizing the electrostatic latent image as a toner image. A bias is applied onto the toner image developed on the surface of the photosensitive body 22 at a position facing the primary transfer roller 29, and thereby the toner image is transferred onto the surface of the intermediate transfer belt 28. A full color toner image is formed on the intermediate transfer belt 28 by superposing color images having different colors from the corresponding photosensitive bodies 22*a*, 22*b*, 22*c*, and 22*d*. After the toner image has been transferred onto the intermediate transfer belt 28, the toner that has not been transferred onto the intermediate transfer belt 28 is removed from the surface of the photosensitive body 22 by the cleaning blade 23, and thereby the photosensitive body 22 is prepared for the next image formation.

The toner image on the intermediate transfer belt 28 is secondarily transferred onto a recording medium being conveyed by a bias applied between the driving roller 26 and the secondary transfer roller 39. The recording medium, on which the toner image has been secondarily transferred, is further conveyed, and when the recording medium passes through the fixing device 71, the toner image is molten and fixed onto the surface of the recording medium by heat and pressure applied to the recording medium. Then, the recording medium is discharged outside the device.

The image forming device 100 can print a full color image onto the surface of the recording medium through the above-described process. Here, the image forming device 100 according to the first embodiment is a tandem type color printer. However, the embodiment of the present invention is not limited to this. For example, the image forming device 100 may be a revolver type color printer, or an image forming device having a document reading device such as a copier or a facsimile device.

<Configuration of Toner Cartridge>

Figure 2:
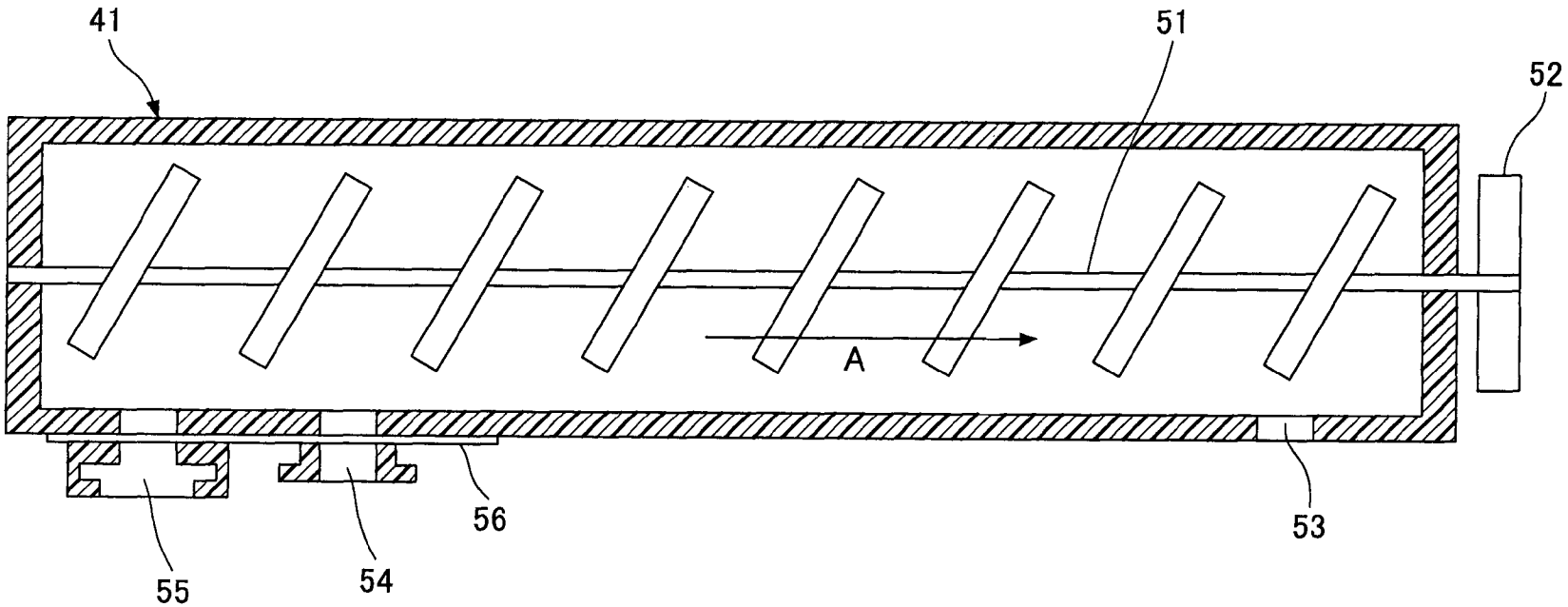
FIG. 2 is a schematic cross-sectional view exemplifying a toner cartridge according to the first embodiment.

FIG. 2 is a schematic cross-sectional view exemplifying the toner cartridge 41 according to the first embodiment.

The toner cartridge 41 is a developer container for storing toner that is utilized as a developer for forming an image. The toner cartridge 41 includes a conveyance screw 51 that is rotatably disposed inside the toner cartridge 41. An end portion of the conveyance screw 51 is exposed outside the toner cartridge 41, and a gear 52 is attached to the exposed portion. The conveyance screw 51 rotates when the gear 52 attached to the conveyance screw 51 is engaged with a gear of the image forming device 100 and a driving force is transmitted to the gear 52. When the conveyance screw 51 rotates, the toner inside the toner cartridge 41 is conveyed to a direction indicated by the arrow A in the figure. Then the toner is dropped from the toner supply port 53, and thereby the toner is supplied to the developing device 31.

Further, the toner cartridge 41 includes a first opening 54 and a second opening 55 that are disposed at an upstream side of the toner supply port 53 in the toner conveyance direction, when the toner is supplied. The first opening 54 is a male-shaped opening, and the second opening 55 is a female-shaped opening. The first opening 54 and the second opening 55 have the shapes such that they can engage with each other.

A sheet shaped sealing member 56 is disposed at the positions of the openings 54 and 55. During normal use, the openings 54 and 55 are sealed so as to prevent the toner from being leaked. The sheet shaped sealing member 56 is disposed so that it can be pulled out along a side surface of the toner cartridge 41. The openings 54 and 55 can be opened by pulling out the sealing member 56.

The used toner cartridge 41 can be connected to another toner cartridge having the same configuration through the openings 54 and 55. The toner cartridge 41 can pass toner remaining therein to the other toner cartridge. Additionally, the toner cartridge 41 can receive toner remaining inside the other toner cartridge.

In this manner, when two used toner cartridges 41 are connected, one of the used toner cartridges 41 can be refilled with the residual toner remaining inside the other used toner cartridge 41. The residual toner can be removed from the other used toner cartridge 41, and the other used toner cartridge 41 can be refilled with new toner. The other used toner cartridge 41 from which the residual toner has been removed and which has been refilled with the new toner can be reused as a toner cartridge that can form a high-quality image. On the other hand, the used toner cartridge 41 to which the residual toner collected from the other used toner cartridge 41 has been refilled can be provided as a less expensive recycled product.

<Refilling of Toner>

Hereinafter, a method of delivering residual toner that remains inside a used toner cartridge 41*a* to a used toner cartridge 41*b* is explained.

Figure 3:
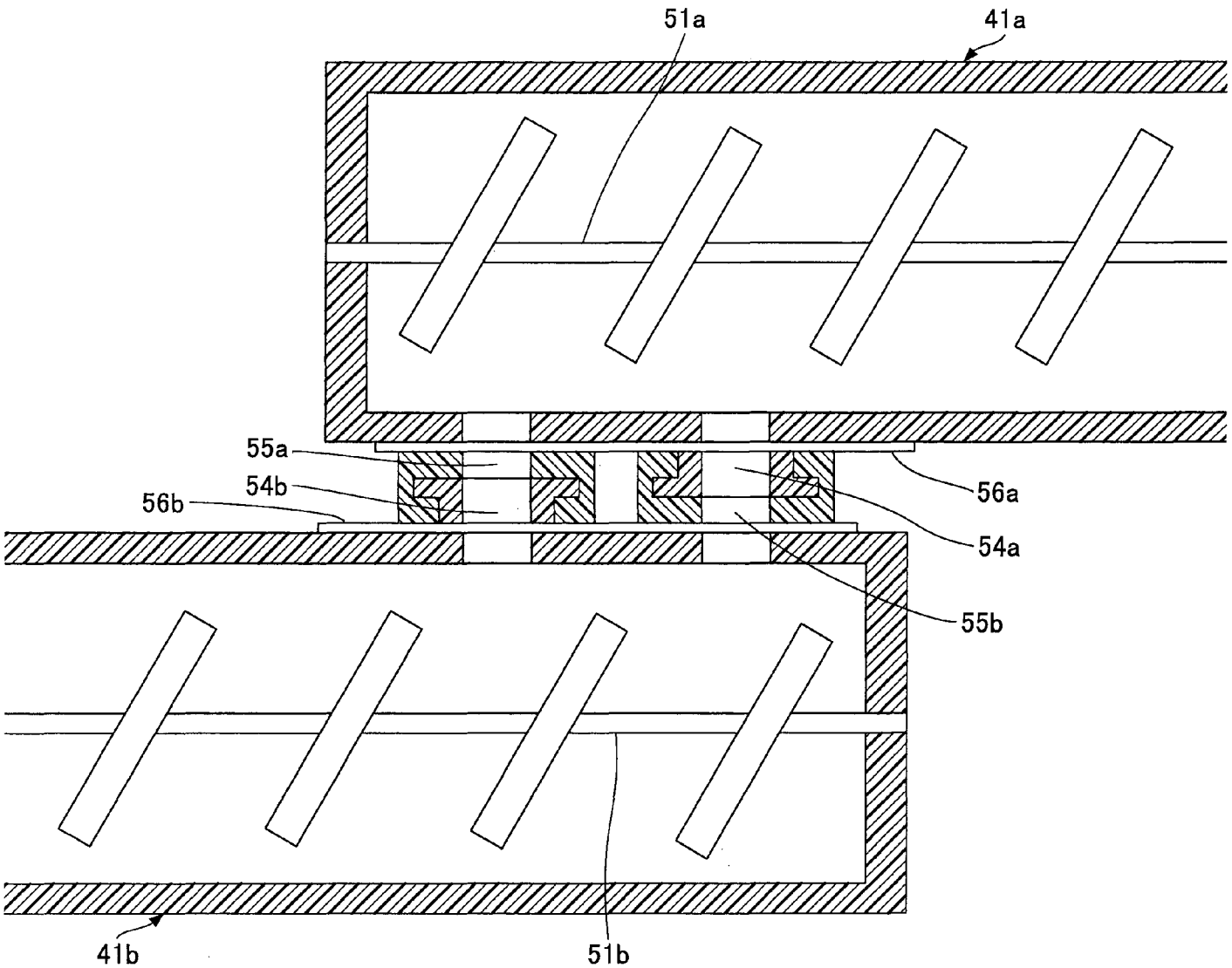
FIG. 3 is a partial enlarged view magnifying connected portions and exemplifying a connected state of the toner cartridges according to the first embodiment.

In order to re-fill the used toner cartridge 41*b* with the residual toner, the toner cartridge 41*a* is connected to the toner cartridge 41*b*. FIG. 3 is a partial enlarged view exemplifying the connected state of the toner cartridge 41*a* and the toner cartridge 41*b* according to the first embodiment.

As shown in FIG. 3, each of the toner cartridges 41*a* and 41*b* is the used toner cartridge 41 having the openings 54 and 55 shown in FIG. 2. The toner cartridges 41*a* and 41*b* can be connected through the openings 54 and 55. Specifically, the two toner cartridges 41*a* and 41*b* can be connected by inserting the opening 54*a* of the toner cartridge 41*a* into the opening 55*b* of the toner cartridge 41*b* and inserting the opening 54*b* of the toner cartridge 41*b* into the opening 55*a* of the toner cartridge 41*a*. Since the openings 54 and 55 have the shapes that engage with each other, the connection between the two toner cartridges 41*a* and 41*b* can be ensured without using, for example, a special member.

When sheet shaped sealing members 56*a* and 56*b* are pulled out, while the two used toner cartridges 41*a* and 41*b* are connected, a state of the toner cartridges 41*a* and 41*b* becomes the state where interiors of the toner cartridges 41*a* and 41*b* communicate with each other, and thereby enabling delivery of the developer.

Figure 4:
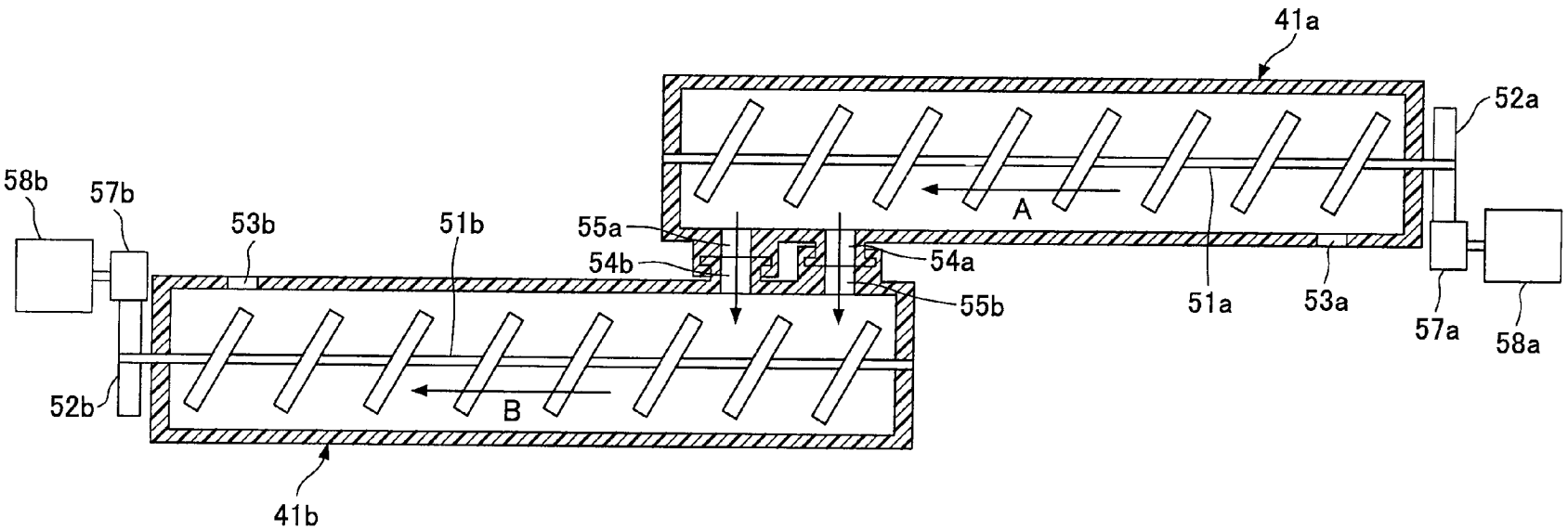
FIG. 4 is a diagram exemplifying a method of delivering toner from one of the connected toner cartridges to the other toner cartridge according to the first embodiment.

Subsequently, the residual toner is refilled by driving conveyance screws 51*a* and 51*b* of the corresponding toner cartridges 41*a* and 41*b*. FIG. 4 is a diagram exemplifying a method of delivering the toner from one of the connected toner cartridges 41*a* and 41*b* to the other toner cartridges according to the first embodiment.

A gear 57*a* is engaged with corresponding gear 52*a* of the conveyance screw 51*a*, and a gear 57*b* is engaged with corresponding gear 52*b* of the conveyance screw 51*b*, so that motors 58*a* and 58*b* as power sources can rotate the corresponding conveyance screws 51*a* and 51*b* while the toner cartridges 41*a* and 41*b* are connected with each other.

In the state of the configuration shown in FIG. 4, the motor 58*a* rotates the conveyance screw 51*a* so as to move the toner remaining inside the toner cartridge 41*a* toward the direction indicated by the arrow A, and conveys the residual toner in the direction in which the residual toner is discharged to the toner cartridge 41*b* through the openings 54 and 55.

In the toner cartridge 41*b*, the motor 58*b* rotates the conveyance screw 51*b* so as to move the residual toner received through the openings 54 and 55 in a di-reaction in which the residual toner is separated from the openings 54 and 55 (the direction indicated by the arrow B in the figure). By rotating the conveyance screw 51*b* of the toner cartridge 41*b* so as to convey the residual toner in the direction of the arrow B, the residual toner can be prevented from being accumulated at the openings 54 and 55, and the residual toner can be quickly received.

By placing the toner cartridge 41*a* that discharges the residual toner upward in the vertical direction and placing the toner cartridge 41*b* that receives the residual toner downward in the vertical direction, the toner can be prevented from remaining inside the toner cartridge 41*a*.

When the refilling of the residual toner from the toner cartridge 41*a* to the toner cartridge 41*b* is completed, subsequently the toner cartridge 41*b* is refilled with the residual toner sequentially from the used toner cartridges 41*c*, 41*d*, . . . , etc.

The toner cartridges 41*a*, 41*c*, 41*d*, . . . , etc. that have discharged the residual toner to the toner cartridge 41*b* can be reused as toner cartridges by newly refilling toner. By newly refilling the toner, degradation of the image quality such as unevenness in the density caused by mixing toner having different use histories can be avoided, and thereby the toner cartridges 41*a*, 41*c*, 41*d*, . . . , etc. can be reused as toner cartridges that can be used for forming high quality images.

Further, the toner cartridge 41*b* that has been refilled with the residual toner can be reused together with the residual toner as a low price toner cartridge. It is possible that, with the low price toner cartridge, unevenness occurs, for example, in a gray image by mixing the toner having different use histories. However, the low price toner is sufficient for outputting characters or solid images with lower image quality.

Second Embodiment

Next, a second embodiment is explained. Here, explanations of the portions of the configuration that are the same as those of the first embodiment are omitted.

Figure 5:
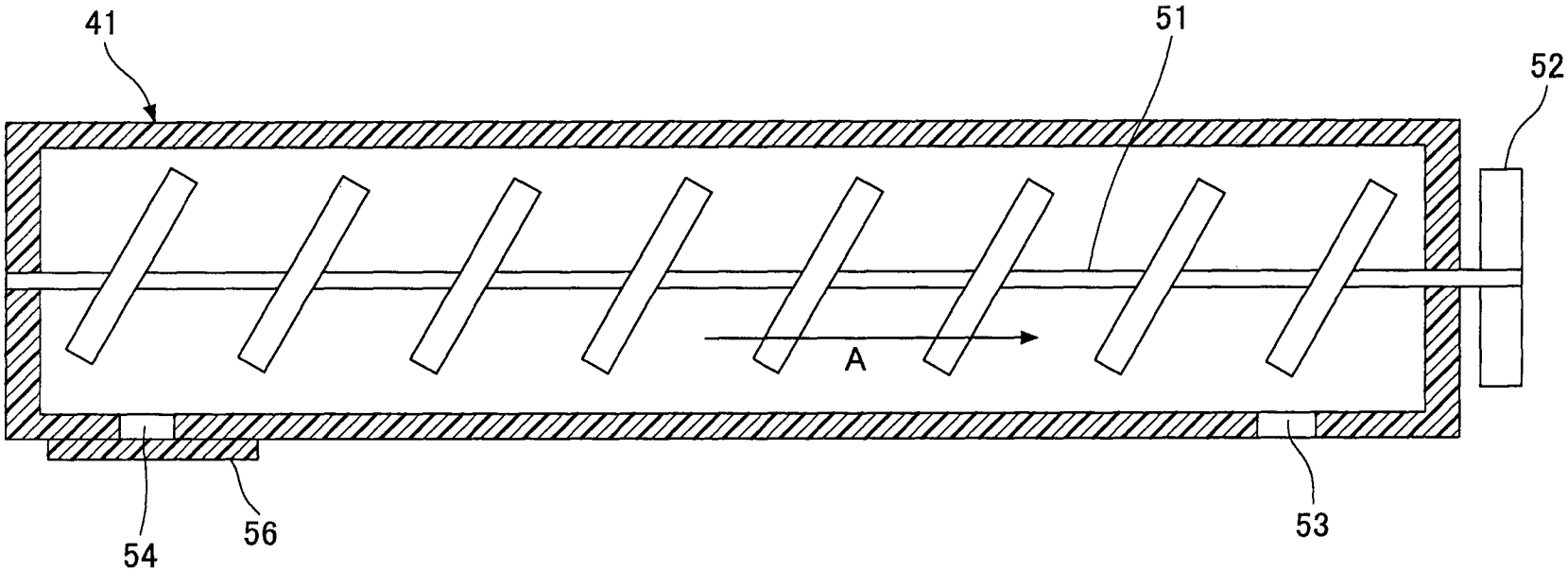
FIG. 5 is a schematic cross-sectional view exemplifying the toner cartridge according to a second embodiment.

FIG. 5 is a schematic cross sectional view exemplifying the toner cartridge 41 according to the second embodiment.

The toner cartridge 41 is a developer container for storing toner that is utilized as developer by the image forming device 100 shown in FIG. 1. The conveyance screw 51 as a conveyor for conveying the toner is rotatably disposed in the toner cartridge 41. Further, one end portion of the conveyance screw 51 is disposed outside the toner cartridge 41, and the gear 52 is attached to the exposed portion. When the connected gear 52 is engaged with the gear of the image forming device 100, the driving force is transmitted, and thereby the conveyance screw 51 is rotated. When the conveyance screw 51 rotates, the toner inside the toner cartridge 41 is conveyed in the direction indicated by the arrow A in the figure. The toner is supplied to the developing device 31 when the toner is dropped from the toner supply port 53.

Further, the toner cartridge 41 includes the opening 54 at an upstream side of the toner supply port 53 in the toner conveyance direction during supply of the toner. At the position of the opening, a slidable sealing member 56 is disposed. During normal use, the slidable sealing member 56 seals the opening 54, and thereby the slidable sealing member 56 prevents the toner from being leaked. The slidable sealing member 56 is disposed so as to be slid along the surface of the toner cartridge 41. The opening 54 can be opened by sliding the sealing member 56.

The residual toner in the used toner cartridge 41 can be discharged to other toner cartridge by connecting the used toner cartridge 41 to the other toner cartridge having the same configuration through the opening 54. Alternatively, the used toner cartridge 41 can receive and collect the residual toner remaining inside the other toner cartridge by connecting the used toner cartridge 41 to the other toner cartridge through the opening 54.

Figure 6:
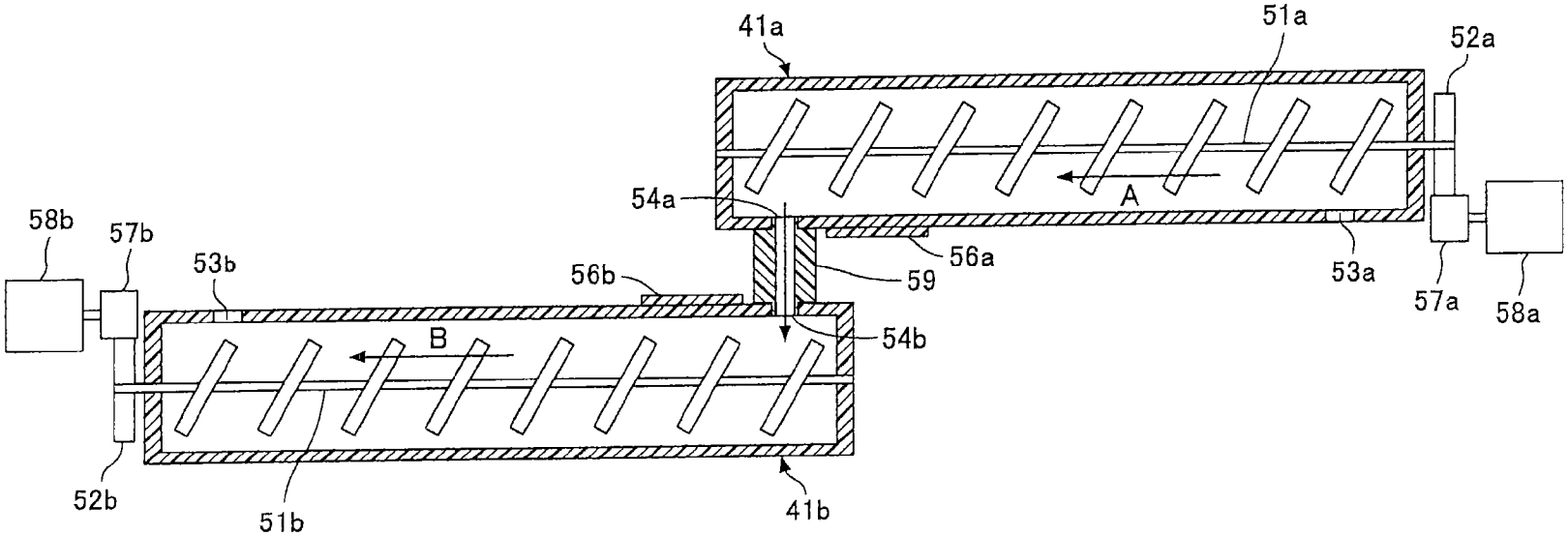
FIG. 6 is a diagram exemplifying the connected state of the toner cartridges according to the second embodiment, and a method of delivering the toner from one of the toner cartridges to the other toner cartridge.

FIG. 6 is a diagram exemplifying a connected state of the toner cartridges 41*a* and 41*b* according to the second embodiment and a method of delivering the toner from one of the toner cartridges 41*a* and 41*b* to the other toner cartridge.

As shown in FIG. 6, the opening 54*a* of the toner cartridge 41*a* and the opening 54*b* of the toner cartridge 41*b* can be connected through a connecting member 59. The connecting member 59 is a member having a cylindrical shape, and the connecting member 59 has a through hole inside. Both end portions of the connecting member 59 have shapes that engage with the openings 54*a* and 54*b* of the toner cartridges 41*a* and 41*b*.

Further, as the power sources for rotating the conveyance screws 51*a* and 51*b* of the toner cartridges 41*a* and 41*b*, the motors 58*a* and 58*b* are provided. The motor 58*a* rotates the conveyance screw 51*a* so as to move the residual toner in the direction of the arrow A in the figure. The motor 58*b* rotates the conveyance screw 51*b* so as to move the residual toner in the direction of the arrow B in the figure. The residual toner can be discharged to the toner cartridge 41*b* through the opening 54*a*, the through hole of the connecting member 59 and the opening 54*b* by the rotations of the conveyance screws 51*a* and 51*b*.

In this manner, the toner cartridges 41*a* and 41*b* and the residual toner can be effectively and efficiently reused by connecting the two used toner cartridges 41*a* and 41*b*, refilling the toner cartridge 41*b* with the residual toner, removing the residual toner from the toner cartridge 41*a* and refilling the toner cartridge 41*a* with new toner.

Third Embodiment

Next, a third embodiment is explained. Here, explanations of the portions of the configuration that are the same as those of the embodiments, which have been explained, are omitted.

Figure 7:
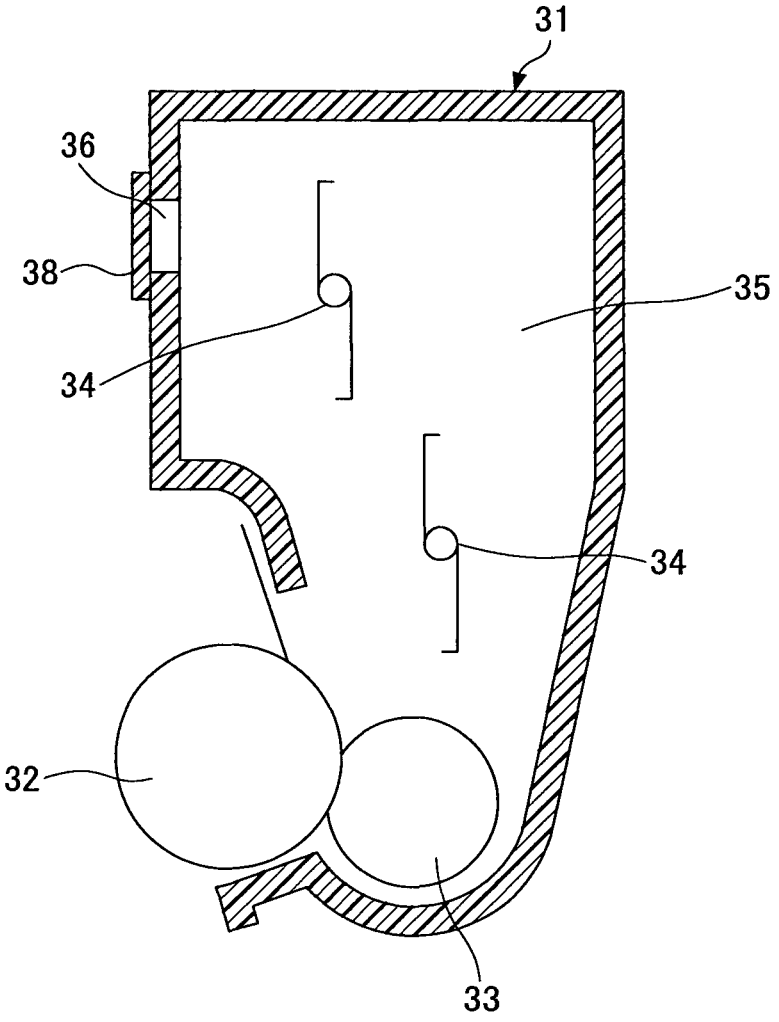
FIG. 7 is a schematic cross-sectional view exemplifying a developing device according to a third embodiment.

FIG. 7 is a schematic cross-sectional view exemplifying the developing device 31 according to the third embodiment.

The developing device 31 is detachably attached to the image forming device 100 shown in FIG. 1. The developing device 31 includes a toner housing chamber 35; agitators 34 that function as agitators and conveyors; a developing roller 32; a supply roller 33 for supplying toner to the developing roller 32; an opening 36 disposed on a side surface at a side of the developing roller 32; and a sealing member 38 that slidably seals the opening 36.

Similar to the toner cartridges 41 according to the first and second embodiments, the developing device 31 and the residual toner can be effectively reused by refilling one of the developing devices 31 with the residual toner and refilling the other developing device 31 with new toner while connecting the two developing devices 31 having the openings 36 shown in FIG. 7.

Figure 8:
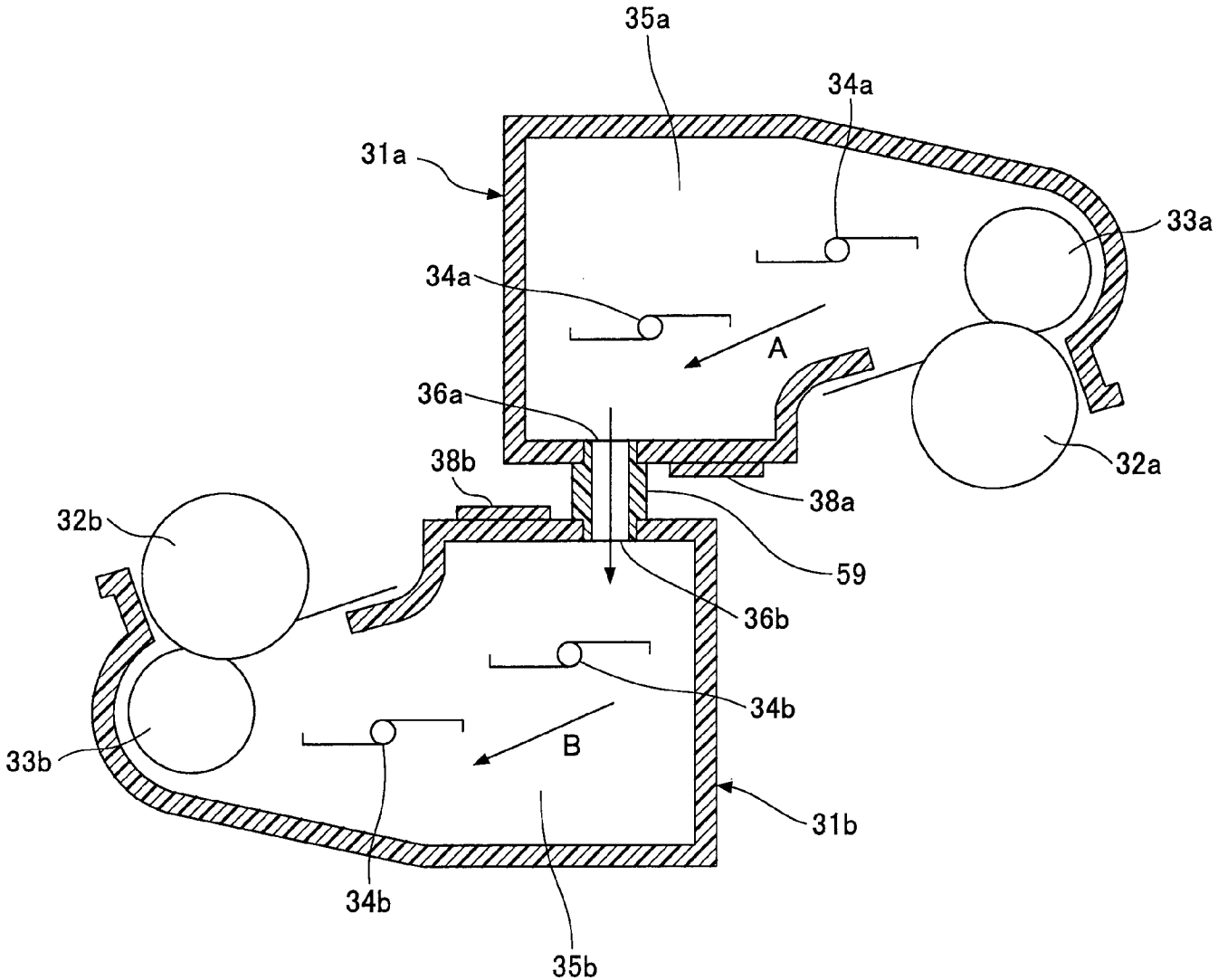
FIG. 8 is a diagram exemplifying a connected state of the developing devices according to the third embodiment and a method of delivering the toner from one of the developing devices to the other developing device.

FIG. 8 is a diagram exemplifying a connected state of the developing devices 31*a* and 31*b* according to the third embodiment and a method of delivering the toner from one of the developing device 31*a* and 31*b* to the other developing device.

As shown in FIG. 8, the openings 36*a* and 36*b* of the developing devices 31*a* and 31*b* can be connected through the connecting member 59. The connecting member 59 is a member having a cylindrical shape, and the connecting member 59 has a through hole inside. Both end portions of the connecting member 59 have shapes that can be engaged with the openings 36*a* and 36*b* of the developing device 31*a* and 31*b*, respectively.

The agitators 34*a* of the developing device 31*a* are rotated so as to move the residual toner in the direction of the arrow A in the figure. The agitators 34*b* of the developing device 31*b* are rotated so as to move the residual toner in the direction of the arrow B in the figure. The residual toner can be delivered from the developing device 31*a* to the developing device 31*b* through the opening 36*a*, the through hole of the connecting member 59 and the opening 36*a* by the rotations of the agitators 34*a* and 34*b*.

In this manner, by connecting the used two developing devices 31*a* and 31*b*, refilling the developing device 31*b* with the residual toner, removing the residual toner from the developing device 31*a*, and refilling the developing device 31*a* with new toner, the developing devices 31*a* and 31*b* and the residual toner can be effectively reused.

Figure 9:
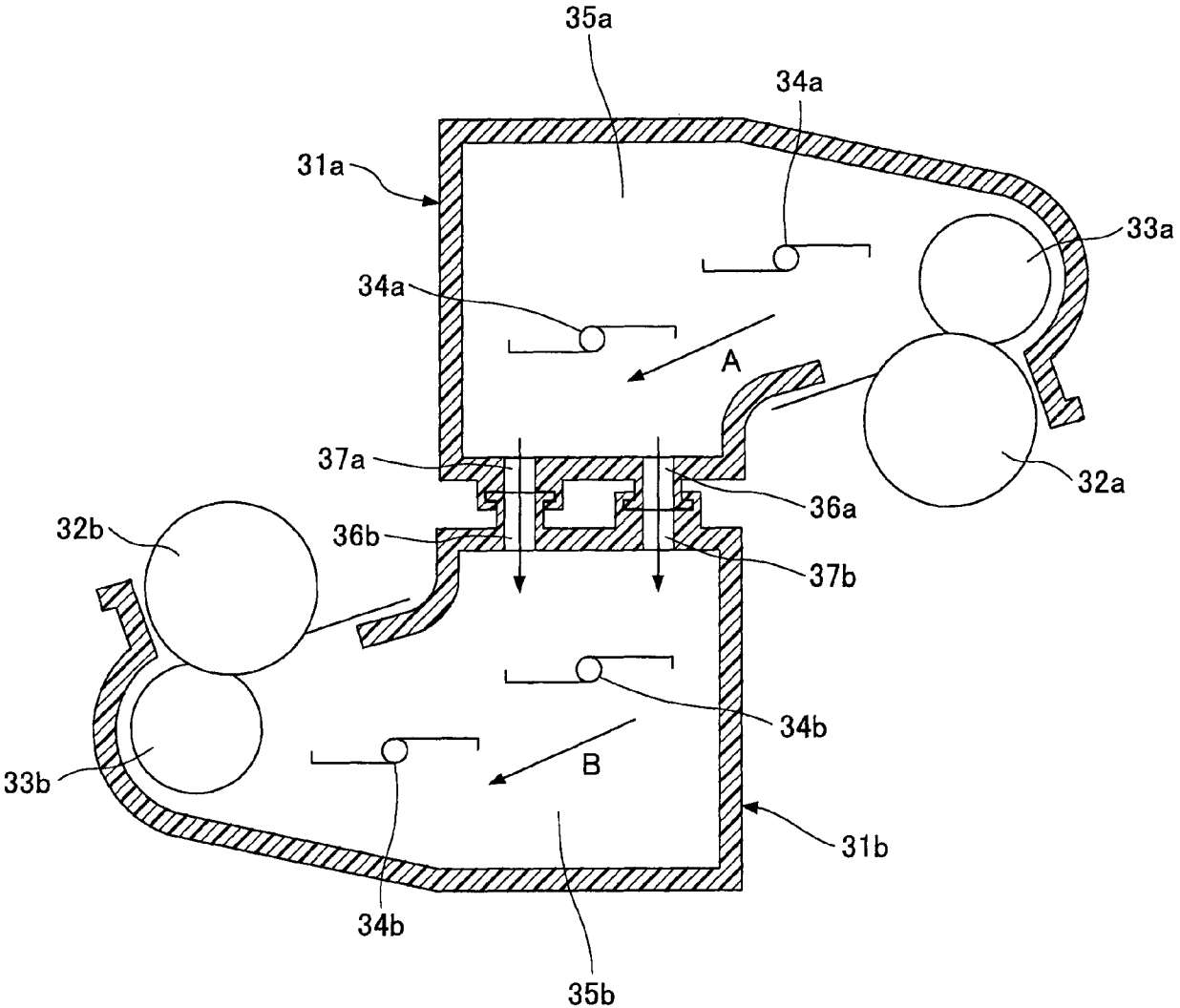
FIG. 9 is a schematic diagram exemplifying another configuration of the developing device according to the third embodiment and a connected state of the developing devices.

Further, by forming the first opening 36 having the male-type shape and the second opening 37 having the female-type shape in the developing device 31, the two used developing devices 31 may be connected through the openings 36 and 37, as shown in FIG. 9.

With such a configuration, the developing devices 31*a* and 31*b* and the residual toner can be efficiently and effectively reused by connecting the two used developing devices 31*a* and 31*b* and refilling one of the developing devices 31*a* and 31*b* with the residual toner.

Fourth Embodiment

Next, a fourth embodiment is explained. Here, explanations of the portions of the configuration that are the same as those of the embodiments, which have been explained, are omitted.

Figure 10:
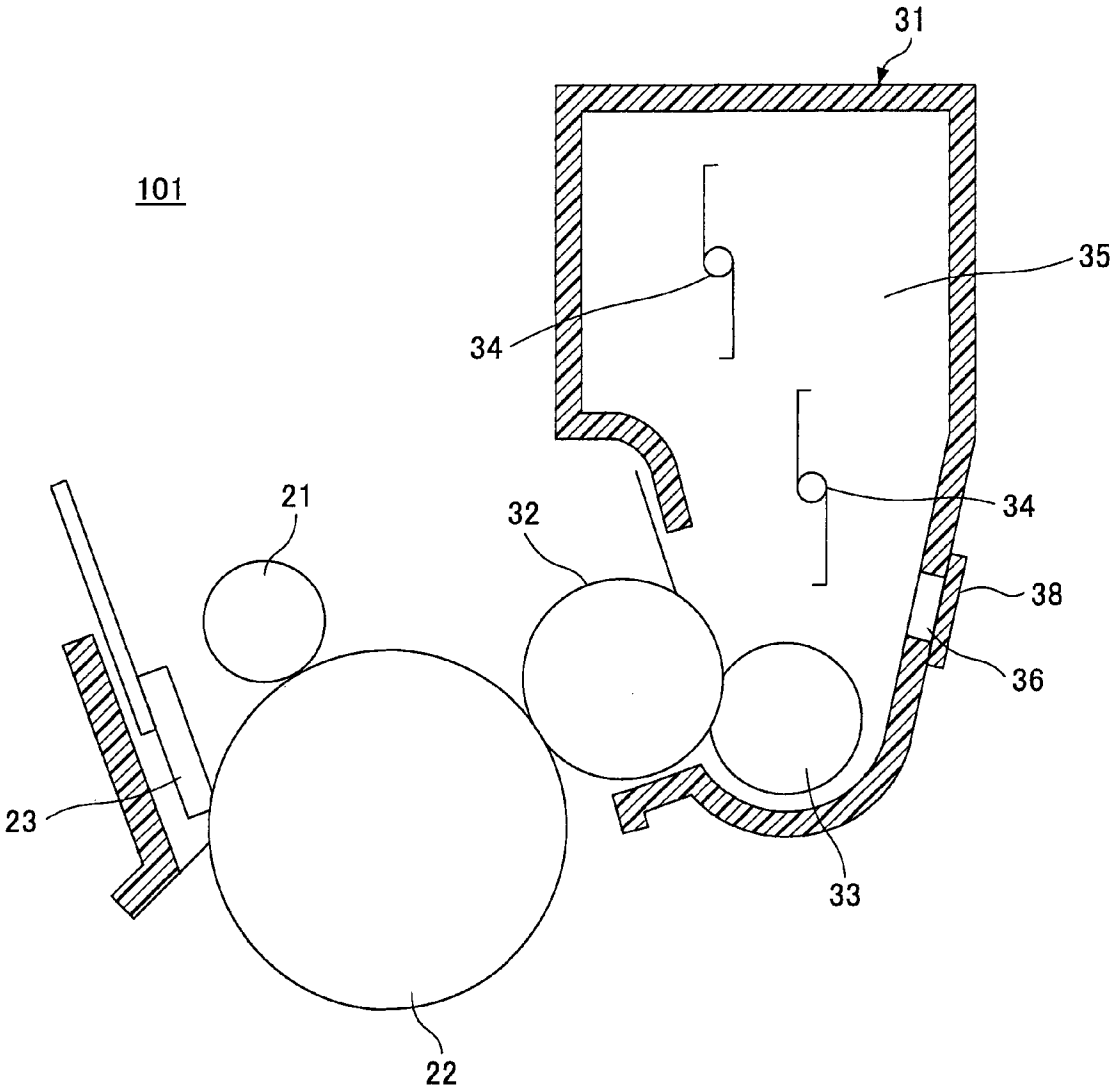
FIG. 10 is a schematic cross-sectional view exemplifying a process cartridge according to a fourth embodiment.

FIG. 10 is a schematic cross-sectional view exemplifying a process cartridge 101 according to the fourth embodiment.

The process cartridge 101 is a unit that is integrally formed with a developing device 31, the photosensitive body 22, the charging roller 21 and the cleaning blade 23. The process cartridge 101 can be detachably attached to the image forming device 100 shown in FIG. 1.

The developing device 31 includes the toner housing chamber 35 for storing toner; the agitators 34 that function as the agitators and the conveyors; the developing roller 32; the supply roller 33 that supplies the toner to the developing roller 32; the opening 36 formed on a side surface at a side of the supply roller 33; and the sealing member 38 that slidably seals the opening 36.

The process cartridge 101 and the residual toner can be effectively reused by refilling the developing device 31 of one of the process cartridges 101 with the residual toner and refilling the developing device 31 of the other process cartridge 101 with new toner, when the used process cartridge 101 having the configuration shown in FIG. 10 is connected to the other process cartridge 101 through the opening 36 of the developing device.

Figure 11:
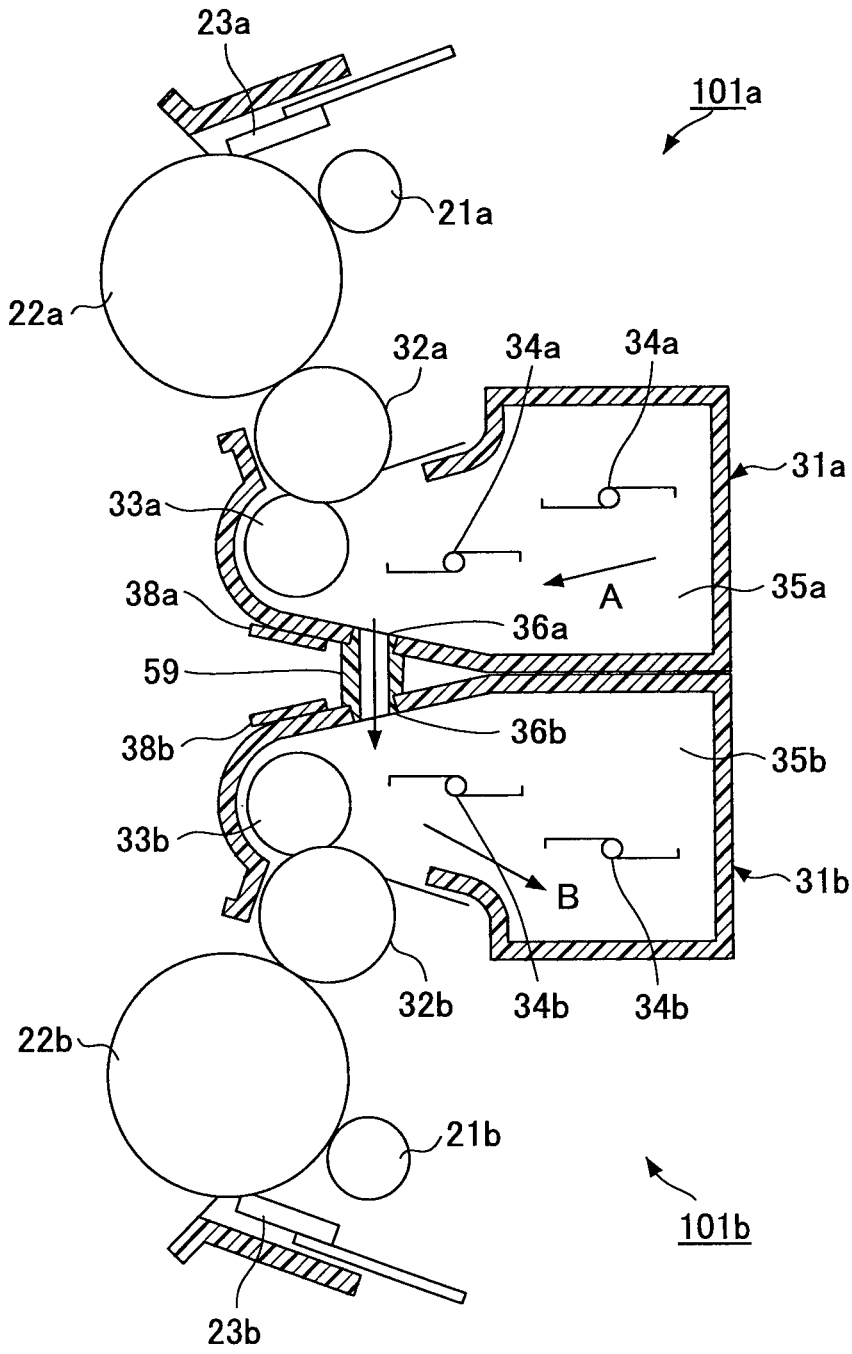
FIG. 11 is a diagram exemplifying a connected state of the process cartridges according to the fourth embodiment, and a method of delivering the toner from one of the process cartridges to the other process cartridge.

FIG. 11 is a diagram exemplifying a connected state of the process cartridges 101*a* and 101*b* according to the fourth embodiment and a method of delivering the toner from the process cartridge 101*a* to the process cartridge 101*b*.

As shown in FIG. 11, the opening 36*a* of the developing device 31*a* of the process cartridge 101*a* and the opening 36*b* of the developing device 31*b* of the process cartridge 101*b* can be connected through the connecting member 59. The connecting member 59 is a member having a cylindrical shape, and the connecting member 59 has a through hole inside. Both the end portions of the connecting member 59 can be engaged with the openings 36*a* and 36*b* of the developing devices 31*a* and 31*b*, respectively.

The agitators 34*a* of the developing device 31*a* are rotated so as to move the residual toner in the direction of the arrow A in the figure. Similarly, the agitators 34*b* of the developing device 31*b* are rotated so as to move the residual toner in the direction of the arrow B in the figure. The residual toner can be delivered from the developing device 31*a* to the developing device 31*b* through the opening 36*a*, the connecting member 59 and the opening 36*b* by the rotations of the agitators 34*a* and 34*b*.

In this manner, the process cartridges 101*a* and 101*b* and the residual toner can be effectively reused by refilling the developing device 31*b* of the process cartridge 101*b* with the residual toner, removing the residual toner from the developing device 31*a* of the process cartridge 101*a* and refilling the developing device 31*a* of the process cartridge 101*a* with new toner, when the two used process cartridges 101*a* and 101*b* are connected.

Figure 12:
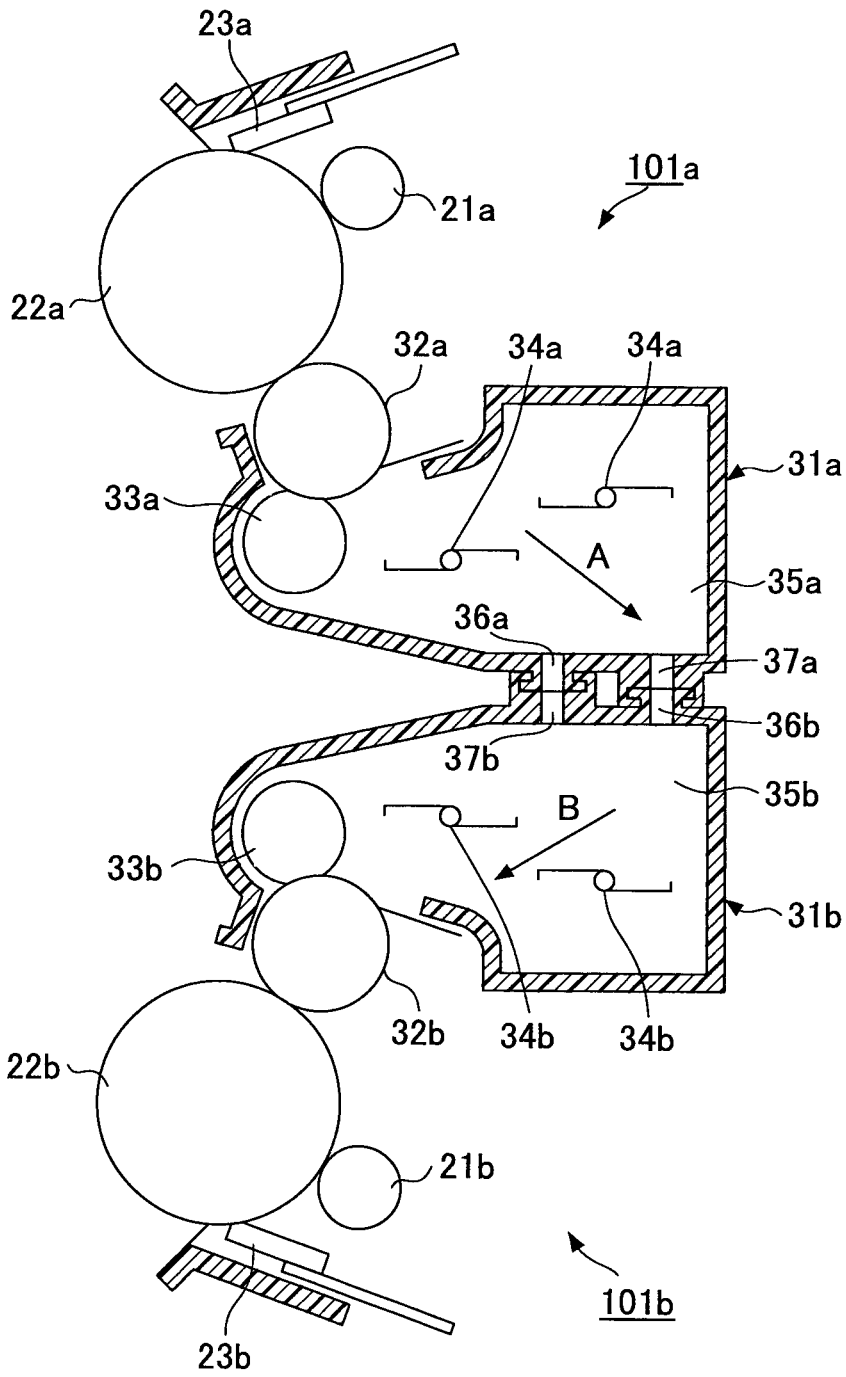
FIG. 12 is a schematic diagram exemplifying another configuration of the process cartridge according to the fourth embodiment and a connected state of the process cartridges.

Further, by forming the first opening 36 having the male-type shape and the second opening 37 having the female-type shape to the developing device 31 of the process cartridge 101, the two used process cartridges 101 can be connected through the openings 36 and 37 of the developing device 31, as shown in FIG. 12.

Similarly, with such a configuration, the process cartridges 101*a* and 101*b* and the residual toner can be efficiently and effectively reused by connecting the two used process cartridges 101*a* and 101*b* and refilling the residual toner to one of the process cartridges 101*a* and 101*b*.

Fifth Embodiment

Figure 13:
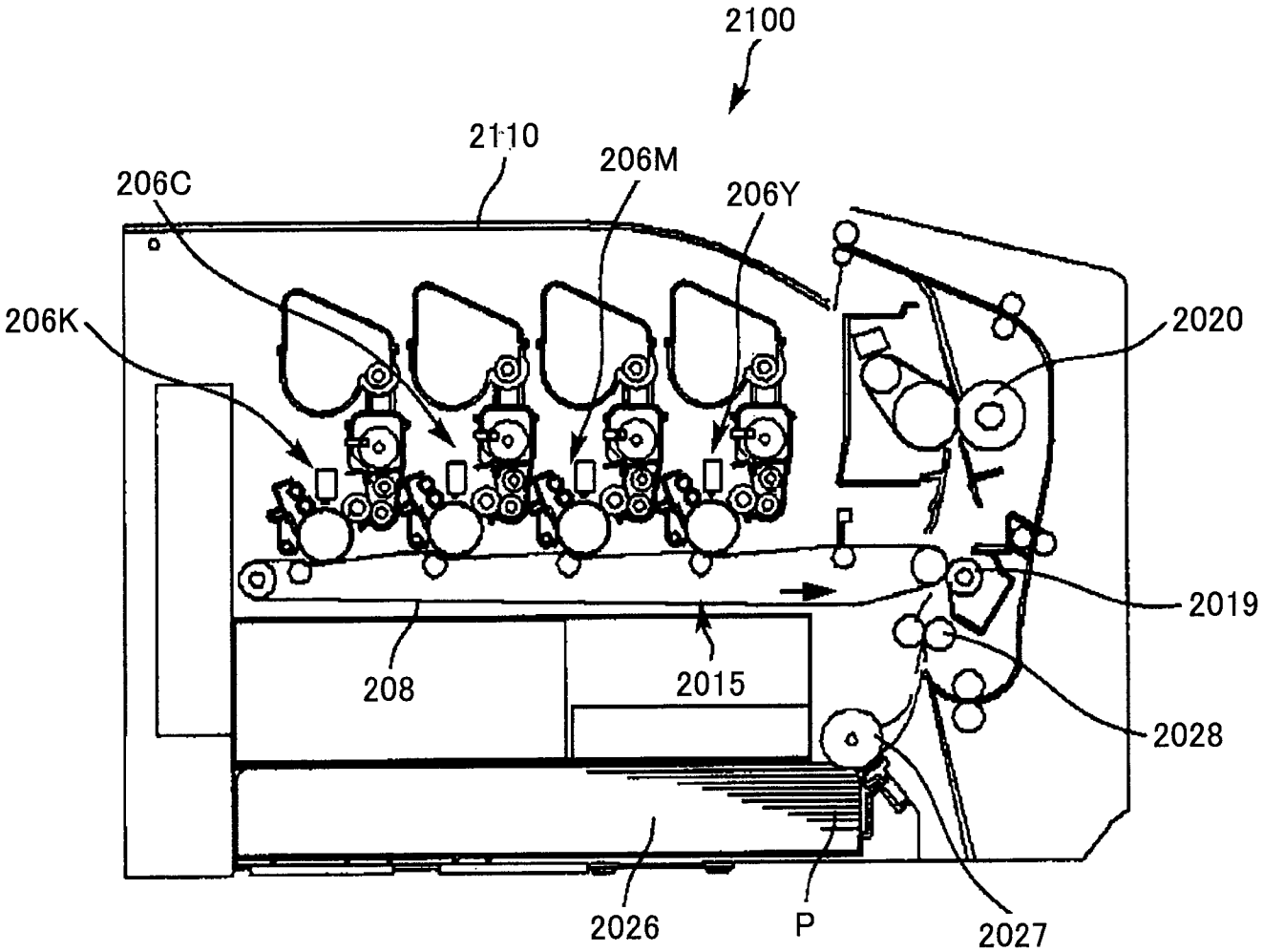
FIG. 13 is an overall configuration diagram showing an image forming device according to a fifth embodiment.
Figure 14:
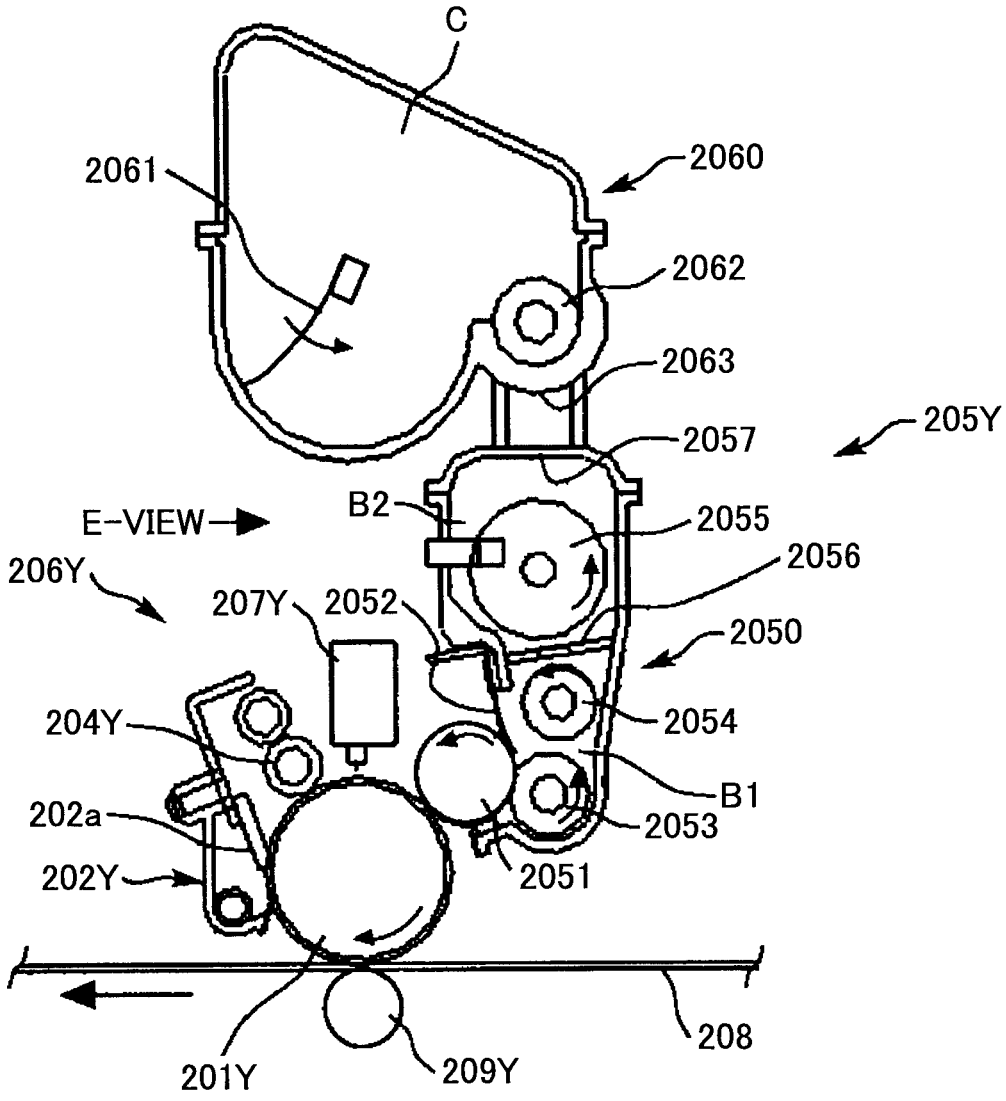
FIG. 14 is a cross-sectional view showing an image forming unit in the image forming device.
Figure 15:
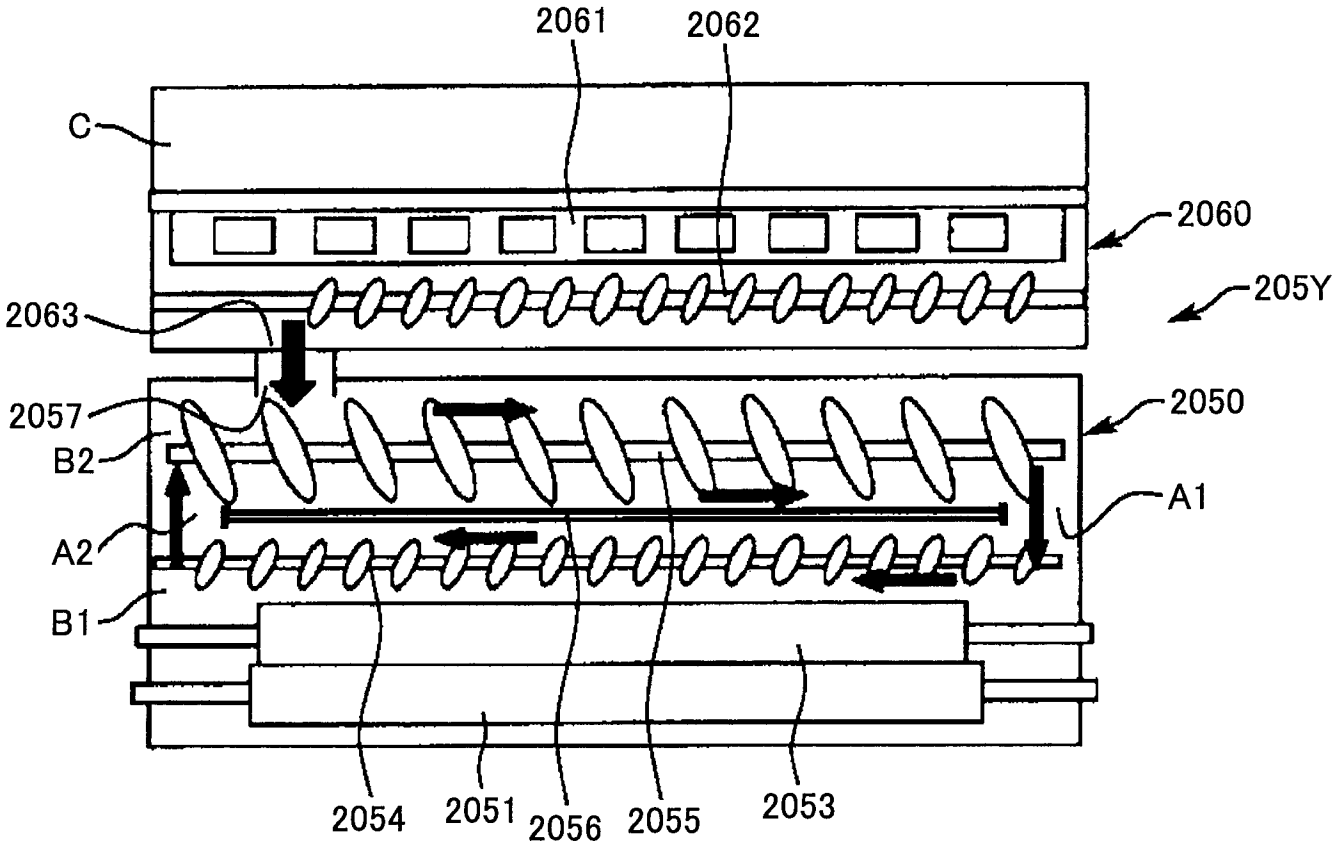
FIG. 15 is a configuration diagram showing a developing device which is attached to the image forming device.

Hereinafter, a fifth embodiment of the present invention is explained in detail by referring to FIGS. 13-17. FIG. 13 is a configuration diagram showing a printer as an image forming device. FIG. 14 is an enlarged view magnifying an image forming unit 206Y in the printer. Further, FIG. 15 is a configuration diagram showing a state of a developing device 205Y where the developing device 205Y is attached to the image forming device. FIG. 15 is a schematic cross-sectional view of the developing device 205Y, when the developing device 205Y is viewed from the E-view direction in FIG. 14. As shown in FIG. 13, an intermediate transfer belt unit 2015 is disposed at a center of an image forming device main body 2100. Further, image forming units 206Y, 206M, 206C, and 206K corresponding to colors of yellow, magenta, cyan, and black are arranged in parallel to face an intermediate transfer belt 208 of the intermediate transfer belt unit 2015.

Referring to FIG. 14, the image forming unit 206Y corresponding to yellow includes a photosensitive drum 201Y as an image supporting body; a charging unit 204Y disposed around the photosensitive drum 201Y; a developing device 205Y; a cleaning unit 202Y; and a neutralization unit (not shown). Image forming processes (a charging process, an exposing process, a developing process, a transferring process, and a cleaning process) are performed on the photosensitive drum 201Y, and a yellow image is formed on the photosensitive drum 201Y.

The three image forming units 206M, 206C, 206K have the same configurations as that of the image forming unit 206Y corresponding to yellow, except that the colors of the toner used for the image forming units 206M, 206C, 206K are different. The image forming units 206M, 206C, 206K form a magenta image, a cyan image, and a black image, respectively. Hereinafter, the explanations for the three image forming units 206M, 206C, and 206K are arbitrarily omitted, and only the image forming unit 206Y corresponding to yellow is explained. Further, due to size restrictions in the drawings and drawing sheet limitations, a complete illustration of the yellow device is provided but description of identical elements used with other colors is omitted to prevent redundancy. Moreover, when there are multiple components of an embodiment having the same structure and/or function, the element may be designated using suffixes such as "a", "b", "c", and "d". As an example, the chamber 35 of FIG. 7 corresponds to the chambers 35*a* and 35*b*, and a separate description of 35*a* and 35*b* is not provided to eliminate redundancies.

Referring to FIG. 14, the photosensitive drum 201Y (image supporting body) is rotationally driven by a motor (not shown) in a clockwise direction. A surface of the photosensitive drum 201Y is uniformly charged (the charging process) at a position of the charging unit 204Y (charging roller).

Subsequently, the surface of the photosensitive drum 201Y reaches a position where light emitted from an exposing unit 207Y (optical writing head) is irradiated, and an electrostatic latent image corresponding to yellow is formed at this position by exposure scanning (the exposing process).

After that, the surface of the photosensitive drum 201Y reaches a position facing the developing unit 205Y (developing device main unit 2050). The electrostatic latent image is developed at this position, and thereby forming a yellow toner image (the developing process). Then, the surface of the photosensitive drum 201Y reaches a position where the surface of the photosensitive drum 201Y faces the intermediate transfer belt 208 and a primary transfer roller 209Y. The toner image on the photosensitive drum 201 is transferred onto the intermediate transfer belt 208 at this position (primary transfer process). At this time, a small amount of toner that has not been transferred onto the intermediate transfer belt 208 is remaining on the photosensitive drum 201Y.

Then, the surface of the photosensitive drum 201Y reaches a position where the surface of the photosensitive drum 201Y faces the cleaning unit 202Y. The toner that has not been transferred and remaining on the photosensitive drum 201Y is collected by a cleaning blade 202*a* and stored in the cleaning unit 202Y (cleaning process). Finally, the surface of the photosensitive drum 201Y reaches a position where the surface of the photosensitive drum 201Y is facing the neutralization unit (not shown), and the residual electric potential on the photosensitive body 201Y is removed at this position. In this manner, the sequence of the image forming processes performed on the photosensitive drum 201Y is terminated.

The above-described image forming processes are performed on the image forming units 206M, 206C, and 206K, similar to the case of the yellow image forming unit 206Y. Namely, light based on image information is irradiated from the exposing unit 207M disposed above the image forming unit 206M onto the photosensitive drum 201M. Similarly, light based on the image information is irradiated from the exposing unit 207C disposed above the image forming unit 206C onto the photosensitive drum 201C, and light based on the image information is irradiated from the exposing unit 207K disposed above the image forming unit 206K onto the photosensitive drum 201K. Subsequently, the toner images corresponding to the colors of yellow, magenta, cyan, and black that have been formed on the corresponding photosensitive drums 201Y, 201M, 201C, and 201K are superposed and transferred onto the intermediate transfer belt 208. In this manner, a color image is formed on the intermediate transfer belt 208.

Referring to FIG. 13, the intermediate transfer belt unit 2015 includes, for example, the intermediate transfer belt 208; the four primary transfer rollers 209Y, 209M, 209C, and 209K (cf. FIG. 14); a driving roller; and a driven roller. The intermediate transfer belt 208 is suspended around and supported by the driving roller, the driven roller, and the primary transfer rollers 209Y, 209M, 209C, and 209K. The intermediate transfer belt 208 is endlessly moved in the direction indicated by the arrow (counterclockwise direction) in FIG. 13 by the rotational drive of the driving roller.

The primary transfer roller 209Y forms a primary transfer nip by sandwiching the intermediate transfer belt 208 between the primary transfer roller 209Y and the photosensitive drum 201Y. A transfer voltage (transfer bias) having a polarity that is opposite to that of the toner is applied to the primary transfer roller 209Y. Then, the intermediate transfer belt 208 moves in the direction indicated by the arrow in FIG. 13, and the intermediate transfer belt 208 sequentially passes through the primary transfer nips corresponding to the primary transfer rollers 209Y, 209M, 209C, and 209K. In this manner, the toner images corresponding to the colors of yellow, magenta, cyan, and black on the photosensitive drums 201Y, 201M, 201C, and 201K are primary transferred onto the intermediate transfer belt 208 while being superposed.

Subsequently, the intermediate transfer belt 208 on which the toner image corresponding to the colors of yellow, magenta, cyan, and black have been superposed reaches a position where the intermediate transfer belt 208 faces a secondary transfer roller 2019. The driving roller (secondary transfer facing roller) forms a secondary transfer nip by sandwiching the intermediate transfer belt 208 between the driving roller and the secondary transfer roller 2019. The four color toner image formed on the intermediate transfer belt 208 is transferred onto a recording medium P, such as a transfer paper, which has been conveyed to the position of the secondary transfer nip. At this time, the toner that has not been transferred onto the recording medium P is remaining on the intermediate transfer belt 208.

Subsequently, the intermediate transfer belt 208 reaches a position of an intermediate transfer cleaning unit (not shown). The toner that has not been transferred and remaining on the intermediate transfer belt 208 is removed at this position. In this manner, the sequence of the intermediate transfer processes performed on the intermediate transfer belt 208 is terminated.

Referring to FIG. 13, the recording medium P has been transferred from a paper feed unit 2026 disposed at a lower portion of the image forming device main body 2100 to the position of the secondary transfer nip through a paper feed roller 2027 and a pair of registration rollers (a pair of timing rollers). Specifically, plural recording media P, such as the transfer papers, are stacked and stored in the paper feed unit 2026. When the paper feed roller 2027 is rotationally driven in the counterclockwise direction in FIG. 13, the recording medium P placed at the upper most position is fed toward a space between the registration rollers 2028.

The recording medium P that has been conveyed to the pair of the registration rollers 2028 is stopped once at the position of a roller nip of the pair of the registration rollers 2028. Here, rotational driving of the pair of the registration rollers 2028 has been stopped. Then, the pair of the registration rollers 2028 is rotationally driven so as to be synchronized with timing of the color image on the intermediate transfer belt 208, and thereby the recording medium P is conveyed toward the secondary transfer nip. In this manner, a desired color image is transferred onto the recording medium P.

After that, the recording medium P, on which the color image has been transferred at the position of the secondary transfer nip, is conveyed to a position of a fixing unit 2020. Then, at this position, the color image that has been transferred onto the surface of the recording medium P is fixed on the recording medium P by heat and pressure from a fixing belt and a pressure roller. After that, the recording medium P is discharged outside the device by a pair of discharging rollers. The recording medium P discharged outside the device by the pair of discharging rollers is sequentially stacked on a stack unit (main body cover 2110). In this manner, the sequence of image forming processes in the image forming device is completed.

Next, the image forming unit 206Y of the image forming device is explained in detail by referring to FIG. 14. As shown in FIG. 14, the image forming unit 206Y includes, for example, a photosensitive drum (image supporting body), the charging unit 204Y (charging roller), the developing device 205Y, and the cleaning unit 202Y. The photosensitive drum 201Y, as the image supporting body, is a negatively charged organic photosensitive body. The photosensitive drum 201Y is rotationally driven in the clockwise direction in FIG. 14 by receiving a driving force from a motor (not shown) disposed in the image forming device main body 2100.

The charging roller 204Y (charging unit) is a roller having elasticity such that a urethane foam layer having middle resistance is formed on a core metal. Here, for example, a urethane resin, carbon black as conductive particles, a sulfurizing agent, and a foaming agent are applied to the urethane foam layer. As a material of the middle resistance layer of the charging roller 204Y, for example, rubber materials formed by dispersing an electrically-conductive material, such as carbon black or a metal oxide, in urethane, ethylene-propylene-diene polyethylene (EPDM), an acrylonitrile butadiene rubber (NBR), a silicone rubber, or an isoprene rubber may be utilized. Here, the electrically-conductive material is dispersed in the rubber material so as to adjust the resistance. Further, as a material of the middle resistance layer, the materials produced by foaming the above rubber materials may be utilized. Incidentally, in the fifth embodiment, the charging roller 204Y contacts the photosensitive drum 201Y. However, the charging roller 204Y may not contact the photosensitive drum 201Y. The cleaning unit 202Y includes a cleaning blade 202*a* that slidably contacts the photosensitive drum 201Y. The cleaning unit 202Y mechanically removes and collects the toner that has not been transferred and remaining on the photosensitive drum 201Y.

In the developing device 205Y, the developing roller 2051Y is arranged to contact the photosensitive drum 201Y. A developing area (developing nip portion) is formed between the developing roller 2051Y and the photosensitive drum 201Y. The toner (single component developer) as the developer is stored in the developing device 205Y. The developing device 205Y develops an electrostatic latent image formed on the photosensitive drum 201Y (the developing device 205Y forms a toner image).

Hereinafter, the developing device 205Y is explained in detail by using FIGS. 14 and 15. Referring to FIG. 14, the developing device 205Y according to the fifth embodiment is a developing device that adopts a single component developing method. The developing device 205Y includes a developing device main unit 2050 for developing the electrostatic latent image formed on the photosensitive drum 201Y; and a toner container 2060 as a developer container that stores the toner (developer) to be supplied to the developing device main unit 2050. The developing device 205Y is detachably (can be replaced) attached to the image forming device main body 2100. Here, the developing device main unit 2050 and the toner container 2060 can be separately replaced. Namely, the toner container 2060 is detachably attached to an upper position of the developing device main unit 2050, which is attached to the image forming device main body 2100. Further, by opening and closing the main body cover 2110 (cf., FIG. 13), while being centered by a hinge (not shown), only the toner container 2060 can be replaced by separating the toner container 2060 from the developing device main unit 2050, or the developing device main unit 2050 (developer device 205Y), to which the toner container 2060 is attached, can be replaced. The toner container 2060 is replaced at a timing where the toner stored inside the toner container 2060 runs out. The developing device 2050 is replaced at a timing where some components of the developing device 2050 (e.g., the developing roller 2051) reach their end of life and the toner inside the developing device 2050 runs out. Therefore, it is possible that the toner container 2060 is separately replaced. However, the developing device main unit 2050 is replaced with the toner container 2060 (in the state where the toner container 2060 is attached to the developing device 2050).

The developing device main unit 2050 includes, for example, a developing roller 2051 as a developer supporting body; a supply roller 2053 as a developer supply member; a doctor blade 2052 as a developer regulating member; a first conveyance screw 2054 and a second conveyance screw 2055 as plural conveyors; a partition member 2056 for separating a first conveyance path B1 including the first conveyance screw 2054 and a second conveyance path B2 including the second conveyance screw 2055; and a main unit side supply port 2057 to which the toner is supplied from the toner container 2060.

The developing roller 2051 (developer supporting body) faces the photosensitive body 201Y while being attached to the image forming device main body 2100, and the developing roller 2051 supplies the toner to the electrostatic latent image formed on the photosensitive drum 201Y. The developing roller 2051 is formed by laminating an elastic layer and a surface layer having electrical conductivity on a core metal. When the developing device main unit 2050 is attached to the image forming device main body 2100, the supply roller 2053 (developer supply member) is disposed below the first conveyance screw 2054 and the second conveyance screw 2055. The supply roller 2053 slides in contact with the developing roller 2051, and thereby supplying the toner to the developing roller 2051. The supply roller 2053 is formed by laminating a foamed polyurethane layer having electric conductivity on a core metal. When the developing device main unit 2050 is attached to the image forming device main body 2100, the doctor blade 2052 (developer regulating member) is arranged to contact the developing roller 2051 with a predetermined pressure and with a predetermined angle. The doctor blade 2052 regulates an amount of the developer supported on the developing roller 2051. A thin plate-shaped member formed of a metal, such as a stainless steel, may be utilized as the doctor blade 2052.

When the first conveyance screw 2054 and the second conveyance screw 2055 (conveyors) are attached to the image forming device main body 2100, the first conveyance screw and the second conveyance screw 2055 convey the toner stored in the developing device main unit 2050 in the longitudinal direction (the direction perpendicular to the paper surface of FIG. 14), and thereby forming a circulation path. The first conveyance screw 2054 is disposed at a position facing the supply roller 2053 (the position above the supply roller 2053) as a first conveyor. The first conveyance screw 2054 supplies the toner onto the supply roller 2053, while horizontally (from right to left in FIG. 15) conveying the toner in the longitudinal direction (the direction of the rotational shaft).

The second conveyance screw 2055 as a second conveyor is disposed at a position facing the first conveyance screw (the position above the first conveyance screw 2054) through the partition member 2056. The second conveyance screw 2055 horizontally conveys (conveys from left to right in FIG. 15) the toner in the longitudinal direction (the direction of the rotational shaft). The second conveyance screw 2055 conveys the toner, which has been circulated from a downstream side in the first conveyance path B1 including the first conveyance screw 2054 through a second relaying portion A2, toward an upstream side of the first conveyance path B1 through a first relaying portion A1 (the circulation indicated by the black arrows in FIG. 15). The rotational shafts of the first conveyance screw 2054 and the second conveyance screw 2055 are almost horizontally arranged, similar to the developing roller 2051 and the photosensitive drum 201Y. The first conveyance screw 2054 is formed by spirally attaching a screw portion to the rotational shaft. Similarly, the second conveyance screw 2055 is formed by spirally attaching a screw portion to the rotational shaft.

The conveyance path including the first conveyance screw 2054 (the first conveyance path B1) and the conveyance path including the second conveyance screw 2055 (the second conveyance path B2) are separated by the partition member 2056 (a wall portion). Referring to FIG. 15, the downstream side of the second conveyance path B2 including the second conveyance screw 2055 communicates with the upstream side of the first conveyance path B1 including the first conveyance screw 2054 through the first relaying portion A1. The toner reached the downstream side in the second conveyance path B2 including the second conveyance screw 2055 is dropped by its own weight at the first relaying portion A1, and thereby the toner reaches the upstream side of the first conveyance path B1. In addition, referring to FIG. 15, the downstream side in the first conveyance path B1 including the first conveyance screw 2054 communicates with the upstream side in the second conveyance path B2 including the second conveyance screw 2055 through the second relaying portion A2. The toner that has not been supplied onto the supply roller 2053 in the first conveyance path B1 is accumulated and pumped up in the vicinity of the second relaying portion A2, and thereby the toner is conveyed (supplied) to the upstream side in the second conveyance path B2 through the second relaying portion A2. Further, in order to improve the transportability of the toner at the second relaying portion A2 (the delivery of the toner from the first conveyance path B1 to the second conveyance path B2 against the gravity), a paddle-shaped portion or a screw portion where the winding direction of the screw is opposite to that of the other portion may be provided at a position in the downstream side of the first conveyance screw 2054 (the position corresponding to the second relaying portion A2).

Referring to FIG. 14, in the developing device main unit 2050, the main unit side supply port 2057 is formed such that it communicates with the container side supply port 2063 of the toner container 2060 at an upper position, when the developing device main unit 2050 is attached to the image forming device main body 2100. The main unit side supply port 2057 is for supplying the toner (developer) from the toner container 2060 to the developing device main unit 2050. Gears (not shown) are attached to the corresponding shaft portions of the developing roller 2051, the supply roller 2053, the first conveyance screw 2054, and the second conveyance screw 2055, and thereby forming a sequence of gears including an idler gear. When a driving force is applied to the sequence of gears from a driving motor (driving source) not shown in the figure, the developing roller 2051, the supply roller 2053, the first conveyance screw 2054, and the second conveyance screw 2055 are rotationally driven in the corresponding directions indicated by the arrows in FIG. 14.

The toner container 2060 as the developer container includes, for example, an agitator 2061; a container side conveyance screw 2062 as a container side conveyor; and a container side supply port 2063 that functions as a toner discharging port during a normal operation. The agitator 2061 is formed by adhering a thin-plate shaped flexible member to a rotational shaft portion. The agitator 2061 conveys the toner stored in a housing unit C of the toner container 2060 toward a conveyance path including the container side conveyance screw 2062 by rotating in the counterclockwise direction in FIG. 14. The container side conveyance screw 2062 (container side conveyor) conveys the toner stored in the toner container 2060 toward the container side supply port 2063 in the longitudinal direction (conveyance from left to the right in FIG. 15), when the developing device 205Y is attached to the image forming device main body 2100. The container side supply port 2063 is formed in the conveyance path including the container side conveyance screw 2062 at an end portion in the longitudinal direction. The toner discharged from the container side supply port 2063 is supplied to the upstream side of the second conveyance path B2 in the developing device main unit 2050 by dropping by its own weight through the main unit side supply port 2057.

The developing device 205Y having such a configuration operates as follows. First, the toner that has been supplied from the toner container 2060 to inside the second conveyance path B2 through the main unit side supply port 2057 and the container side supply port 2063 circulates in the developing device main unit 2050, and the toner is supplied to the first conveyance path B1, while being agitated and mixed by the second conveyance screw 2055. The toner that has been conveyed into the first conveyance path B1 is conveyed by the first conveyance screw 2054, and a portion of the toner is supplied to the supply roller 2053 and supported on the supply roller 2053. The toner supported on the supply roller 2053 is frictionally charged at a pressed portion between the supply roller 2053 and the developing roller 2051. After that, the toner is transferred onto the developing roller 2051 and supported by the developing roller 2051. Then, the toner supported on the developing roller 2051 is thinned and homogenized, and subsequently the toner reaches the position where the developing roller 2051 contacts the photosensitive drum 201Y (developing area). At this position, the toner is attached to a latent image formed on the photosensitive drum 201Y by an electric field (developing electric field) formed at the developing area.

Hereinafter, the developer collecting method in the developing device 205Y (the developing device main unit 2050 and the toner container 2060) according to the fifth embodiment is explained. In the fifth embodiment, for example, when the developing device 205Y is, to be recycled and the toner remaining inside the developing device main unit 2050, which has been removed from the image forming device main body 2100, is to be collected, the developing device main unit 2050 is attached to the toner container 2060 in an arrangement which is different from the arrangement between the developing device main unit 2050 and the toner container 2060 when the developing device 205Y is attached to the image forming device main body 2100. With such an arrangement, the first conveyance screw 2054 and the second conveyance screw 2055 are driven similar to the case where the developing device 205Y is attached to the image forming device main body 2100, and thereby the toner is discharged from the developing device main unit 2050 and the toner is collected inside the toner container 2060.

Figure 16:
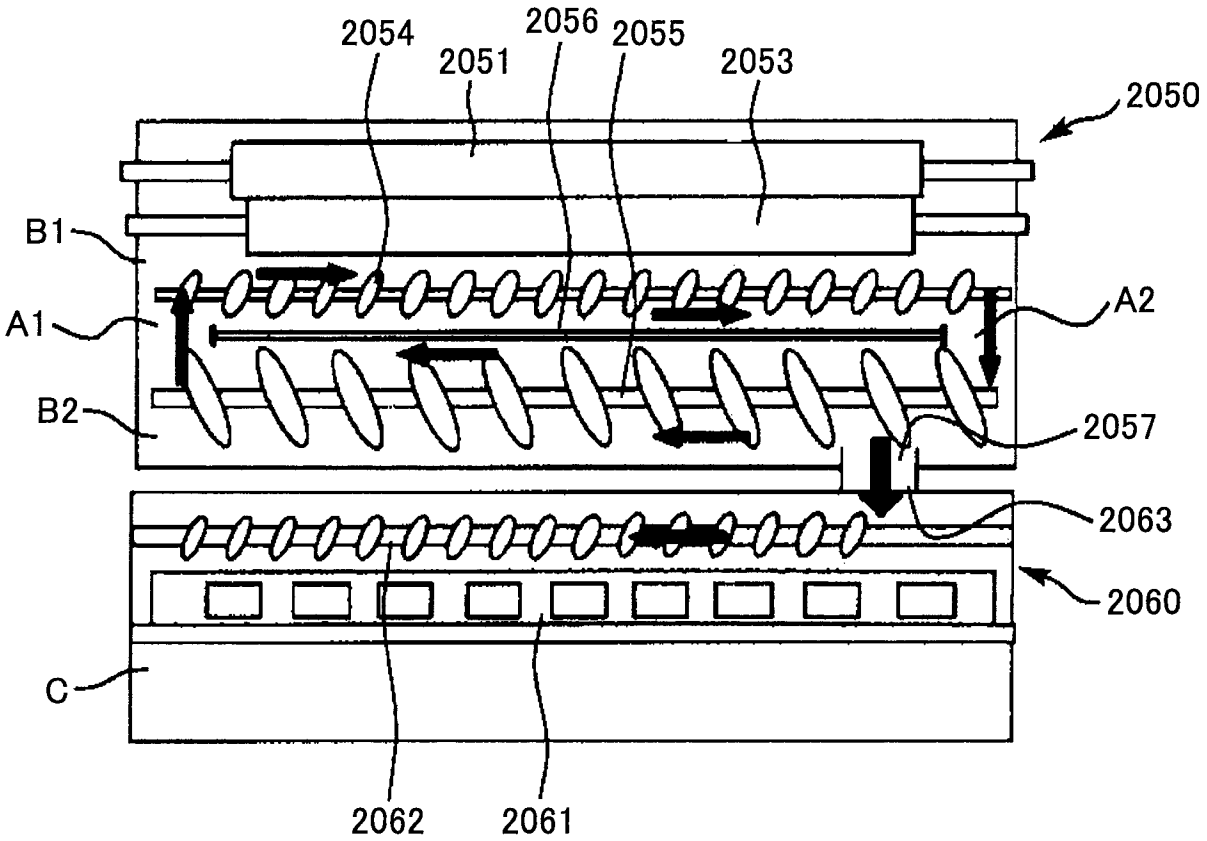
FIG. 16 is a diagram showing the developing device during collection of developer.

Specifically, referring to FIG. 16, when the toner remaining inside the developing device main unit 2050, which has been removed form the image forming device main body 2100, is to be collected, the developing device main unit 2050 is attached (set) to the toner container 2060 so that the container side supply port 2063 communicates with the main unit side supply port 2057 while the developing device main unit 2050 and the toner container 2060 are arranged to be upside down with respect to the arrangement of the developing device main unit 2050 and the toner container 2060 when the developing device 205Y is attached to the image forming device main body 2100. Namely, during a normal operation where the developing device 205Y is attached to the image forming device main body 2100, the developing device main unit 2050 is set so that the first conveyance screw 2054 and the second conveyance screw 2055 are disposed above the developing roller 2051 and the supply roller 2053 and the main unit side supply port 2057 opens upward, as shown in FIG. 15. Additionally, the toner container 2060 is set so that the container side supply port 2063 opens downward above the developing device main unit 2050. Contrary to this, when the developing device 205Y is removed from the image forming device main body 2100 and the toner is to be collected, the developing device main unit 2050 is set so that the first conveyance screw 2054 and the second conveyance screw 2055 are disposed below the developing roller 2051 and the supply roller 2053 and the main unit side supply port 2057 opens downward, as shown in FIG. 16. Additionally, the toner container 2060 is set so that the container side supply port 2063 opens upward below the developing device main unit 2050.

Then, in the state where the developing device main unit 2050 and the toner container 2060 are arranged as shown in FIG. 16, the first conveyance screw 2054 and the second conveyance screw 2055 in the developing device main unit 2050 are rotationally driven in the normal directions (the directions indicated by the arrows in FIG. 14), similar to the case where the developing device 205Y is attached to the image forming device main body 2100. With this, the toner remaining inside the developing device main unit 2050 is discharged from the main unit side supply port 2057, while circulating as indicated by the black arrows in FIG. 16, and thereby the toner is collected inside the toner container 2060 through the container side supply port 2063. It is preferable to perform such a toner collecting task without rotating the developing roller 2051 and the supply roller 2053. However, even if the developing roller 2051 and the supply roller 2053 are rotated with the first conveyance screw 2054 and the second conveyance screw 2055, since an amount of the toner circulated in the circulation paths B1 and B2 is small and the developing roller 2051 and the supply roller 2053 are disposed above the circulation paths B1 and B2, it is not likely that the toner is supplied from the circulation paths B1 and B2 to the supply roller 2053. Further, since the toner is discharged from the main unit side supply port 2057 disposed at the bottom most portion of the circulation paths E1 and B2, while being circulated within the circulation paths B1 and B2 by rotational drives of the first conveyance screw 2054 and the second conveyance screw 2055 similar to the case of the normal operation, the amount of the toner remaining inside the developing device main unit 2050 can be made to almost zero.

Further, when such a toner collecting task is performed (when the toner remaining inside the developing device main unit 2050 removed from the image forming device main body 2100 is collected), it is preferable that the container side conveyance screw 2062 be rotationally driven in a direction that is opposite to the direction in which the container side conveyance screw 2062 is rotationally driven when the developing device 205Y is attached to the image forming device main body 2100. With this, the toner that has been conveyed inside the toner container 2060 from the developing device main unit 2050 through the container side supply port 2063 is conveyed to a side which is separated from the container side supply port 2063 in the longitudinal direction (conveyance from right to left in FIG. 16) by the rotational drive in the opposite direction by the container side conveyance screw 2062. Therefore, it can be ensured that the toner is collected inside the housing unit C of the toner container 2060, without being spilled from the container side supply port 2063.

Here, such a toner collecting task during recycling can be performed after the developing device 205Y (the developing device 205Y includes the developing device main unit 2050 and the toner container 2060) has been removed from the image forming device main body 2100 by opening and closing the main body cover 2110 and the developing device 205Y has been delivered to a recycling plant. In this case, the toner collecting task can be performed, while attaching a special tool (the special tool includes a holding unit for holding the developing device main unit 2050 and the toner container 2060 as shown in FIG. 16 and a drive motor that rotationally drives the first conveyance screw 2054, the second conveyance screw 2055, and the container side conveyance screw) to the developing device 205Y placed in the recycling plant. In this case, the delivered developing device 205Y is attached to the special tool, while the developing device 205 is in the upside-down state. Then, by performing the above-described toner collecting task, the toner inside the developing device main unit 2050 is cleanly emptied, and the toner collected inside the toner container 2060 (residual toner) can be reused. Specifically, the toner container 2060 in which the residual toner has been collected is separated from the developing device main unit 2050, and subsequently another special tool is attached to the toner container 2060 and the toner container 2060 is filled (refilled) with new toner. Then, the toner container 2060 is reproduced as a toner container 2060 for recycling, after a sealing member has been newly attached to the container side supply port 2063. On the other hand, the developing device main unit 2050 from which the residual toner has been almost perfectly removed is reproduced as a developing device main unit 2050 for recycling, after a simple, cleaning task and a necessary replacement task for replacing some components have been performed.

In the fifth embodiment, the developer collecting task is performed as a part of the recycling process. However, the developer collecting task can be performed as a part of a manufacturing process for manufacturing and shipping a new developing device. Specifically, in a manufacturing plant for manufacturing a new developing device 205Y, toner is collected from the developing device 205Y, and the developing device 205Y is packaged and shipped in a clean state, after the manufactured developing device 205Y has been filled with the toner (the toner for validation) and an operation check (e.g., confirmation of image quality of an output image) has been completed. In the toner collecting process in such a case, the toner collecting task is performed similar to that of the fifth embodiment. In this manner, the toner for the validation can be collected in the toner container 2060 (toner container for the validation process) without wasting it.

Figure 17B:
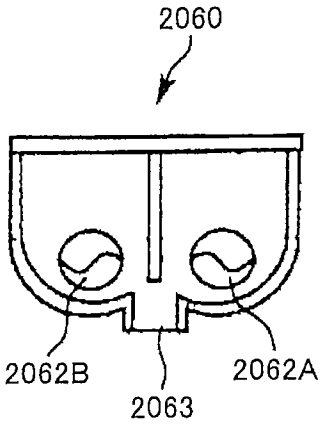
FIG. 17B is a diagram showing an X1-X1 cross-section in FIG. 17A.
Figure 17A:
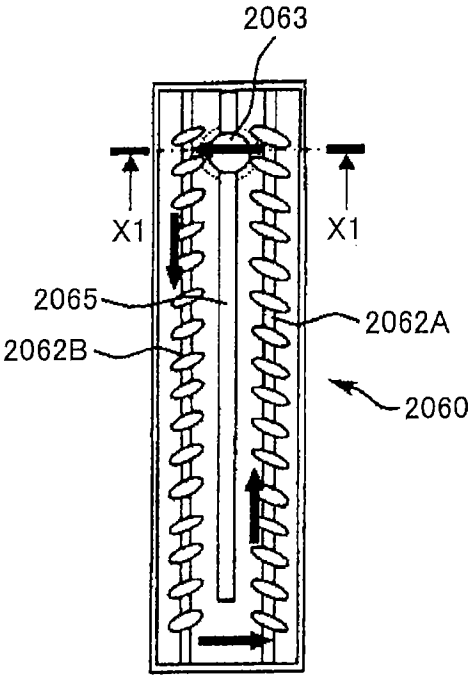
FIG. 17A is a cross-sectional view of a developer container having another configuration, when the developer container is viewed from above.

The toner container 2060 according to the fifth embodiment includes the container side conveyance screw 2062 (container side conveyor). When the developing device 205Y is attached to the image forming device main body 2100, the toner is conveyed in the conveyance path including the container side conveyance screw 2062 toward the container side supply port 2063 in the longitudinal direction. When the toner is collected, the toner is conveyed in the conveyance path including the container side conveyance screw 2062 in the longitudinal direction so as to be separated from the container side supply port 2063. On the other hand, as shown in FIG. 17A, the toner container 2060 may include plural container side conveyance screws 2062A and 2062B (container side conveyors). With such a configuration, when the developing device 205Y is attached to the image forming device main body 2100, the toner is conveyed toward the container side supply port 2063, while the toner is circulated in the longitudinal direction in conveyance paths including the corresponding container side conveyance screws 2062A and 2062B. In such a case, it is preferable to rotationally drive the two container side conveyance screws 2062A and 2062B during the collection of the toner, so as to prevent the toner that is collected from the container side supply port 2063 from leaking outside the container. The effects are the same whether the rotational directions are the normal directions (the rotational directions with which the circulation in the direction indicated by the black arrows in FIG. 17A is formed) or the opposite directions (the rotational directions with which the circulation in a direction which is opposite to the direction indicated by the black arrows in FIG. 17A is formed).

As described above, in the fifth embodiment, the plural conveyance screws 2054 and 2055 (conveyors), which convey the toner (developer) in the longitudinal direction and form the circulation path, are arranged in parallel in the vertical direction through the partition member 2056 in the developing device main unit 2050. When the developer remaining inside the developing device main unit 2050 removed from the image forming device main body 2100 is collected, the toner container 2060 (developer container) is attached to the developing device main unit 2050 in an arrangement that is different from the arrangement when the developing device 205Y is attached to the image forming device main body 2100, and the toner is discharged from the developing device main unit 2050 and collected inside the toner container 2060 by driving the plural conveyance screws 2054 and 2055. In this manner, the toner remaining inside the developing device 205Y is cleanly collected, and the toner collected from the developing device 205Y can be reused without discarding it.

Sixth Embodiment

Figure 18:
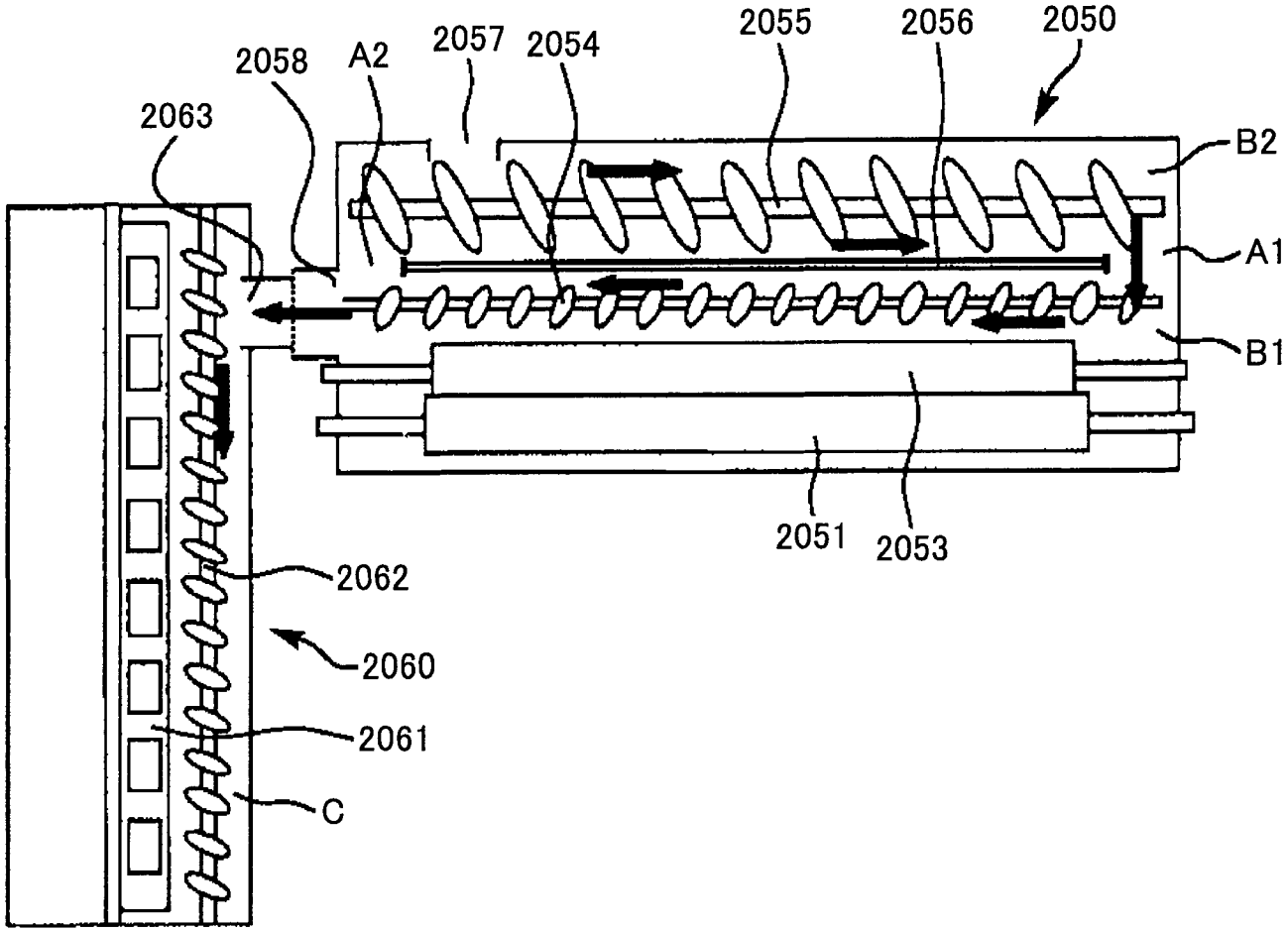
FIG. 18 is a diagram showing a developing device during collection of developer according to a sixth embodiment of the present invention.
Figure 19:
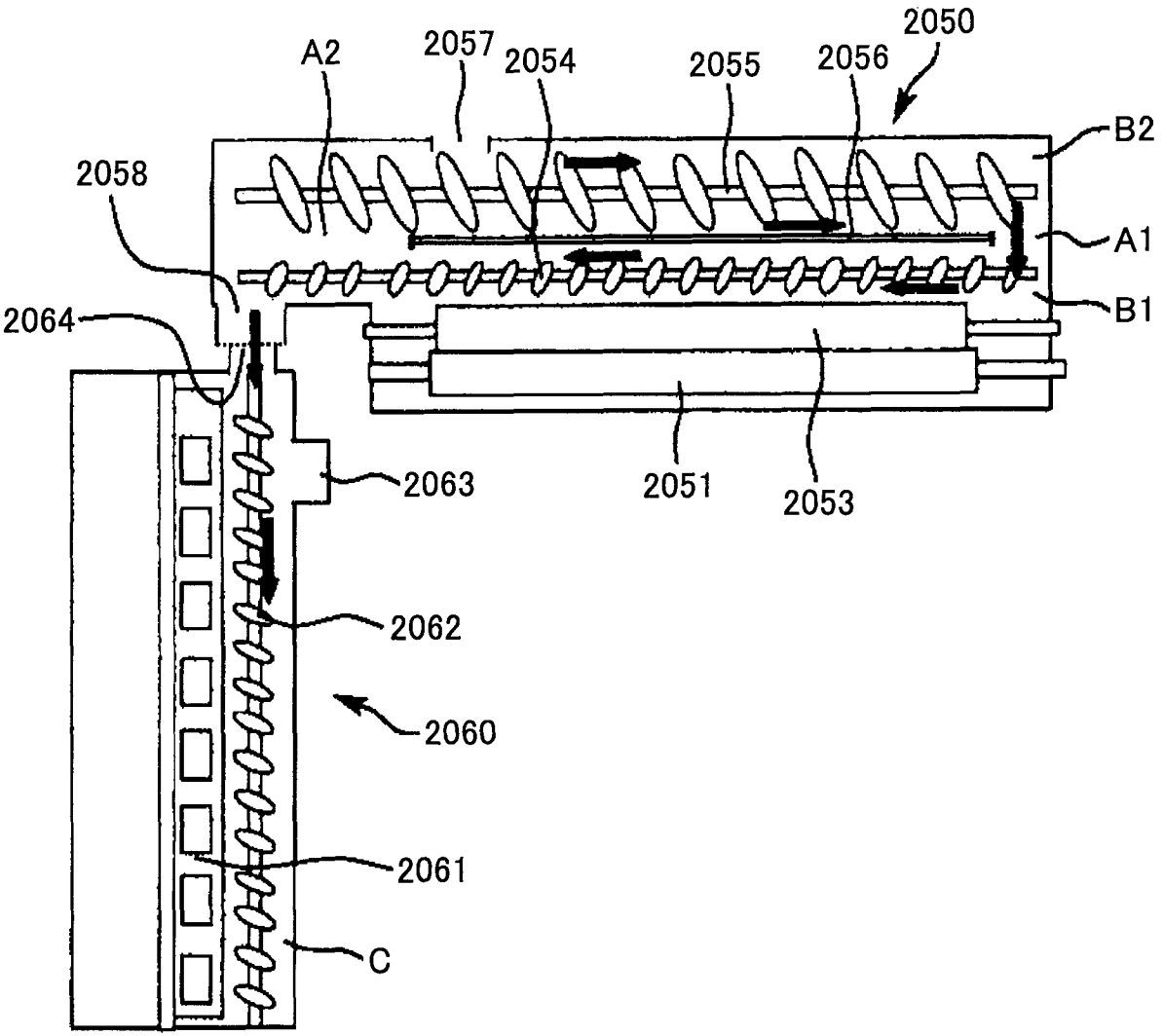
FIG. 19 is a diagram showing a developing device during collection of developer as a modified example.
Figure 20:
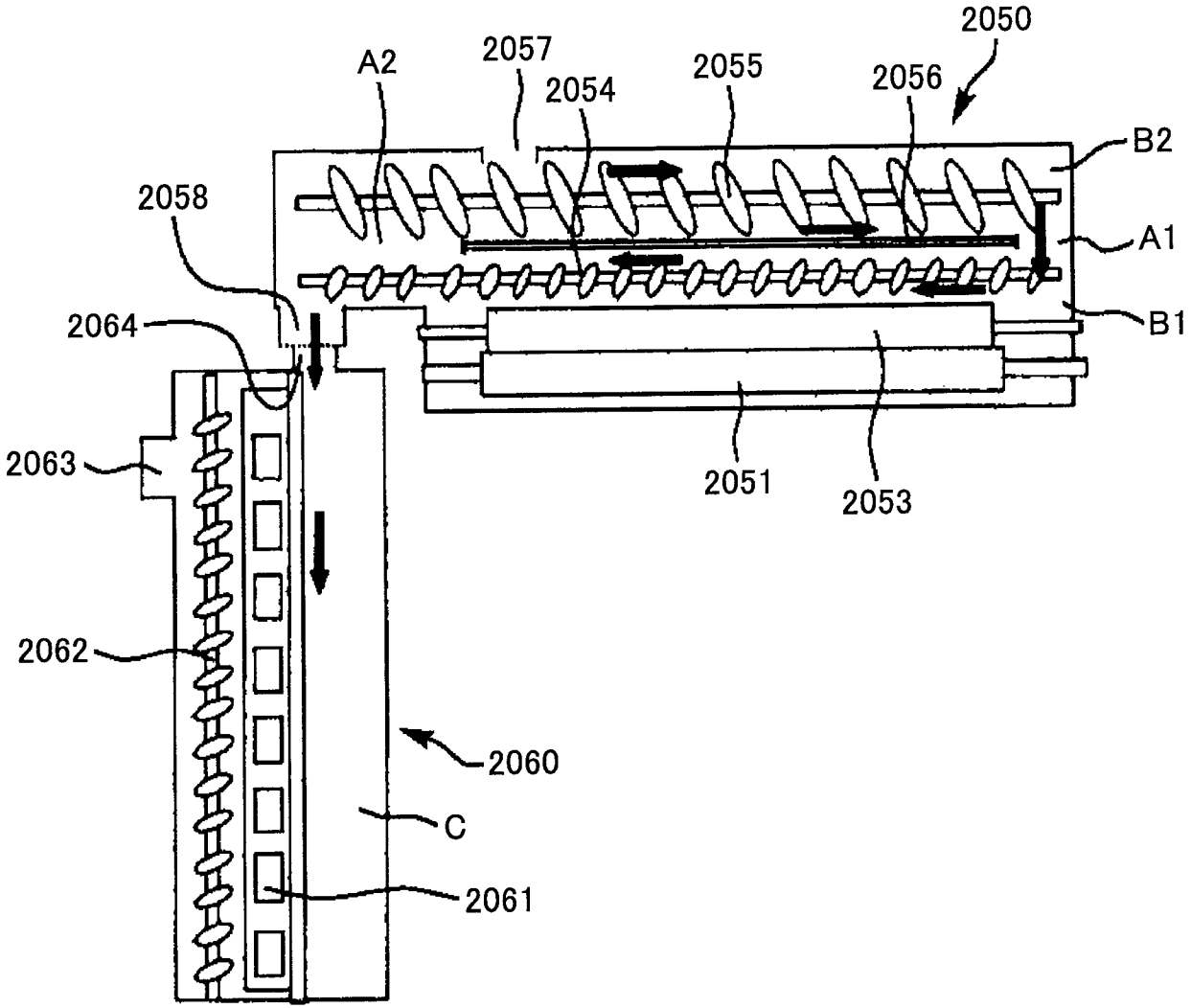
FIG. 20 is a diagram showing a developing device during collection of developer as another modified example.

Referring to FIGS. 18-20, a sixth embodiment of the present invention is explained in detail. FIG. 18 is a diagram showing a developing device during collection of developer according to the sixth embodiment. FIG. 18 corresponds to FIG. 16 in the fifth embodiment. Further, FIGS. 19 and 20 are diagrams showing developing devices during collection of developer according to corresponding modified examples. A developer collecting method according to the sixth embodiment is different from that of the fifth embodiment in a point that the developing device main unit 2050 is disposed in an arrangement that is the same as the arrangement when the developing device main unit is attached to the image forming device main body 2100, and the developer container 2060 is disposed in a state where the longitudinal direction of the developer container 2060 is set to be the vertical direction.

The developing device 205Y according to the sixth embodiment includes the developing device main unit 2050 and the toner container 2060 (developer container), similar to that of the fifth embodiment. The developing device main unit 2050 includes, for example, the developing roller 2051 (developer supporting body); the supply roller 2053 (developer supply member); the doctor blade 2052 (developer regulating member); the plural conveyance screws 2054 and 2055 (conveyors); the partition member 2056; and the main unit side supply port 2057. Further, the toner container 2060 includes, for example, the agitator 2061; the container side conveyance screw 2062 (container side conveyor); and the container side supply port 2063. Similar to the case of the fifth embodiment, during a normal operation, the developing device main unit 2050 and the toner container 2060 of the developing device 205Y are attached to the image forming device main body 2100 as shown in FIGS. 14 and 15, and the image forming process is performed.

Referring to FIG. 18, the developing device main unit 2050 in the sixth embodiment includes a main unit side, opening 2058 that is formed to be openable and closeable and disposed at an end portion in the longitudinal direction in the circulation paths B1 and B2. During a normal operation where the developing device 205Y is attached to the image forming device main body 2100 (an operation other than the toner collecting operation), the main unit side opening 2058 is covered (closed), for example, with a seal member or a shutter member. As shown in FIG. 18, when the toner remaining inside the developing device main unit 2050 removed from the image forming device main body 2100 is collected (during collection of the toner), the main unit side opening 2058 is opened so that the main unit side opening 2058 communicates with the container side supply port 2063, and the developing device main unit 2050 is attached (set) to the toner container 2060 so as to maintain the arrangement of the circulation paths in the horizontal direction. In this state, the two conveyance screws 2054 and 2055 are rotationally driven in the normal directions, similar to the case where the developing device 205Y is attached to the image forming device main body 2100.

With this, the toner remaining inside the developing device main unit 2050 is discharged from the main unit side opening 2058, while being circulated in the direction indicated by the black arrows in FIG. 18, and the toner is collected inside the toner container 2060 through the container side supply port 2063. Such a toner collecting task is performed in a state where an amount the toner being circulated in the circulation paths B1 and B2 is small. Since the toner is discharged from the main unit side opening 2058 positioned at the end portion of the first conveyance path B1, while being circulated in the circulation paths B1 and B2, by rotationally driving the two conveyance screws 2054 and 2055 similar to the case of the normal operation, the toner remaining inside the developing device main unit 2050 can be discharged while leaving almost no quantities of the toner in the developing device main unit 2050.

Further, when such a toner collecting task is performed, it is preferable that, in the toner container 2060, the container side conveyance screw 2062 is rotationally driven in a rotational direction that is opposite to the rotational direction for the case where the developing device 205Y is attached to the image forming device main body 2100. In the sixth embodiment, during the collection of the toner, the toner container 2060 is attached to the developing device main unit 2050, so as to dispose the container side supply port 2063 at an upper position and so as to set the longitudinal direction to be the vertical direction. Therefore, the toner flowed from the container side supply port 2063 tends to enter inside the toner container 2060 by dropping by its own weight. However, when the container side conveyance screw 2062 is rotationally driven in the opposite direction as described above, a force is applied to the toner so as to convey the toner in the direction in which the toner is separated from the container side supply port 2063, and thereby ensuring that the toner is collected inside the housing unit C of the toner container 2060.

Further, as shown in FIG. 19, an openable and closable container side opening 2064 may be formed at an end portion in the longitudinal direction in the toner container 2060 according to the sixth embodiment. During the collection of the toner, the container side opening 2064 may be communicated with the main unit side opening 2058. During a normal operation in which the developing device 205Y is attached to the image forming device main body 2100 (an operation other than the toner collecting operation), the container side opening 2064 is covered (closed), for example, with a seal member or a shutter member. When the toner remaining inside the developing device main unit 2050 removed from the image forming device main body 2100 is collected, the main unit side opening 2058 and the container side opening 2064 (which are closed when the developing device 205Y is attached to the device main body) are opened and the main unit side opening 2058 and the container side opening 2064 are communicated with each other. At this time, the developing device main unit 2050 is attached to the toner container 2060 so as to maintain the arrangement of the circulation paths B1 and B2 in the horizontal direction. Then, the plural conveyance screws 2054 and 2055 are rotationally driven in directions that are the same directions for the normal operation, and the container side conveyance screw 2062 is rotationally driven in a direction that is opposite to the direction for the normal operation. In such a case, during the collection of the toner, the toner container 2060 is arranged in such a way that the container side opening 2064 is disposed at an upper position and the longitudinal direction becomes the vertical direction. At this time, it is preferable that the container side supply port 2063 be sealed, for example, by the seal member. Additionally, it is preferable that the main unit side opening 2058 of the developing device main unit 2050 be formed to open downward in the state shown in FIG. 19.

Additionally, as shown in FIG. 20, in the toner container 2060 according to sixth embodiment, during the collection of the toner, the toner discharged from the developing device main unit 2050 may be collected inside the toner container 2060 only by free falling, without rotationally driving the container side conveyance screw 2062. Namely, when the toner remaining inside the developing device main unit 2050 removed from the image forming device main body 2100 is collected, the toner container 2060 is arranged in such a way that the longitudinal direction becomes the vertical direction, and the toner discharged from the developing device main unit 2050 falls by its own weight and thereby the toner is collected inside the toner container 2060. In such a case, it is preferable that the openable and closable container side opening 2064 similar to that of FIG. 19 be formed at the end portion in the longitudinal direction in the toner container 2060, and, during the collection of the toner, the container side opening 2064 be communicated with the main unit side opening 2058 of the developing device main unit 2050. Further, in order to avoid interference between the container side conveyance screw 2062 and the toner that falls by its own weight, unlike the container side opening 2064 shown in FIG. 19, it is preferable that the container side opening 2064 be formed at a portion (an end portion in the longitudinal direction of the housing unit C shown in FIG. 20) other than the conveyance path including the container side conveyance screw 2062.

As described above, in the sixth embodiment, similar to the case of the fifth embodiment, the plural conveyance screws 2054 and 2055 (conveyors), which convey the toner (developer) in the longitudinal direction and form the circulation path, are arranged in parallel in the vertical direction through the partition member 2056 in the developing device main unit 2050. When the developer remaining inside the developing device main unit 2050 removed from the image forming device main body 2100 is collected, the toner container 2060 (developer container) is attached to the developing device main unit 2050 in an arrangement that is different from the arrangement when the developing device 205Y is attached to the image forming device main body 2100, and the toner is discharged from the developing device main unit 2050 and collected inside the toner container 2060 by driving the plural conveyance screws 2054 and 2055. In this manner, the toner remaining inside the developing device 205Y is cleanly collected, and the toner collected from the developing device 205Y can be reused without discarding it.

Additionally, in the sixth embodiment, during the collection of the toner, the developing device main unit 2050 is connected (attached) to the toner container 2060, while the arrangement in the vertical direction and in the horizontal direction are maintained to be the same as that of during the normal operation (when the developing device 205Y is attached to the image forming device main body 2100). In contrast, during the collection of the toner, the developing device main unit 2050 may be connected (attached) to the toner container 2060, while the developing device main unit 2050 is reversed in the vertical direction (the arrangement in the horizontal direction is maintained) with respect to the arrangement in the case of the normal operation (when the developing device 205Y is attached to the image forming device main body 2100). In such a case, the main unit side supply port 2057 or the main unit side opening 2058 (which is to be formed at the side of the second conveyance path B2) may be utilized for discharging the toner from the developing device main unit 2050.

Seventh Embodiment

Figure 21:
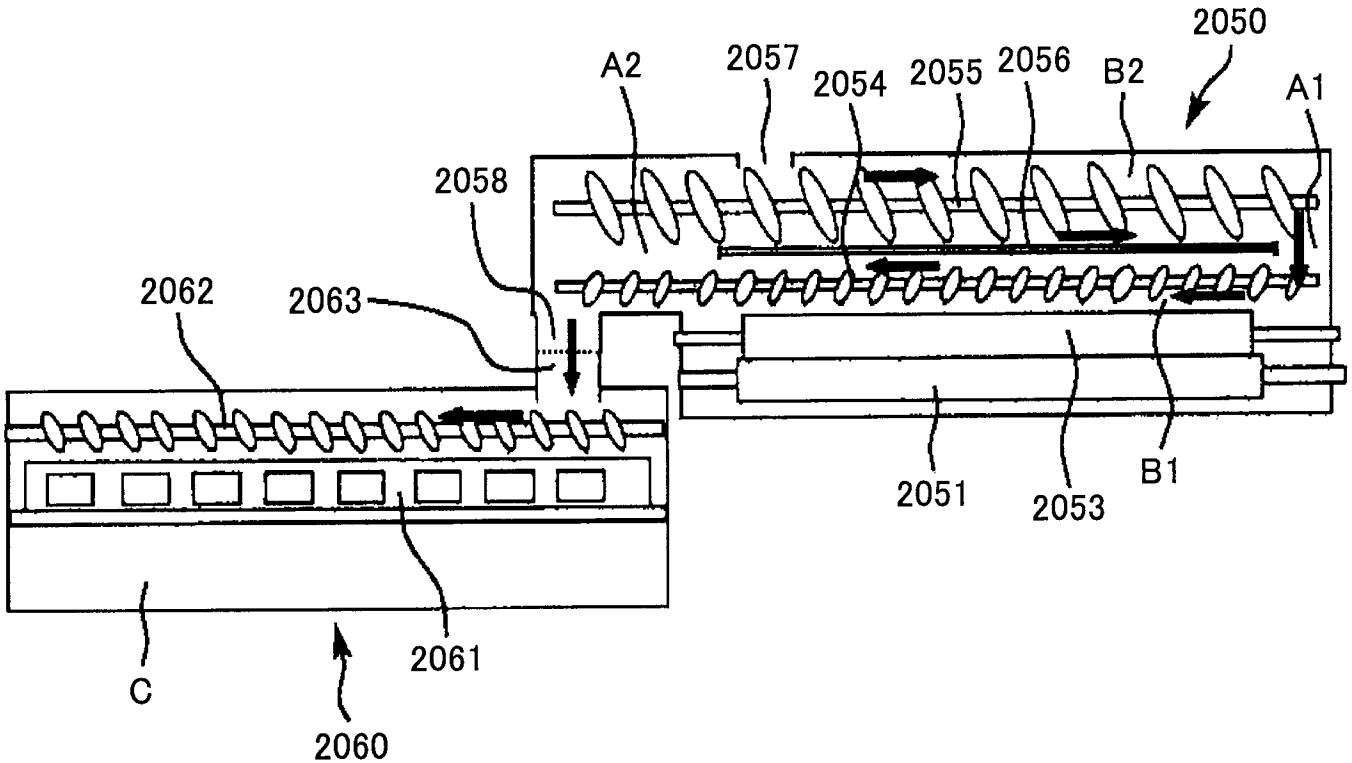
FIG. 21 is a diagram showing a developing device during collection of developer according to a seventh embodiment of the present invention.
Figure 22:
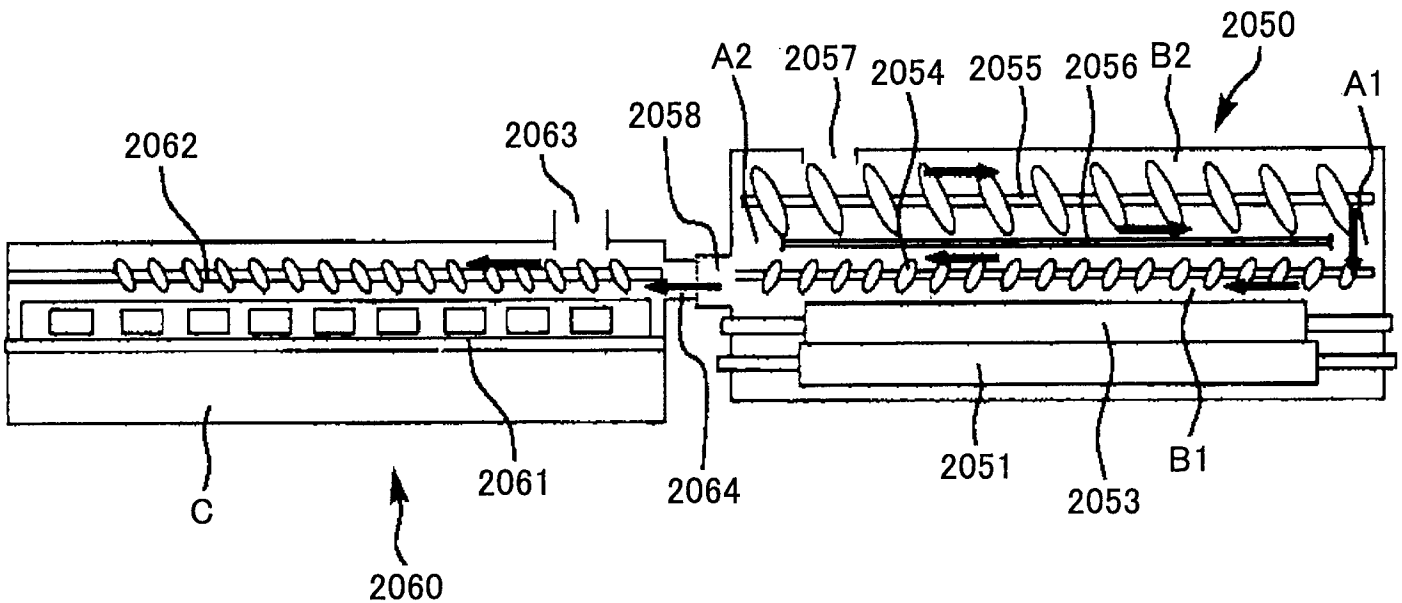
FIG. 22 is a diagram showing a developing device during collection of developer as a modified example.

Referring to FIGS. 21 and 22, a seventh embodiment of the present invention is explained in detail. FIG. 21 is a diagram showing the developing device during the collection of the developer according to the seventh embodiment. FIG. 21 corresponds to FIG. 16 in the fifth embodiment. FIG. 22 is a diagram showing the developing device during the collection of the developer according to a modified example. A developer collecting method according to the seventh embodiment is different from that of the fifth embodiment in a point that the developing device main unit 2050 is attached to the developer container 2060, while an arrangement of the developing device main unit 2050 is maintained to be the same as the arrangement when the developing device 205Y is attached to the image forming device main body 2100, but the developer container 2060 is attached to the developing device main unit 2050, while the developer container 2060 is reversed in the vertical direction with respect to the arrangement when the developing device 205Y is attached to the image forming device main body 2100.

Similar to the fifth and sixth embodiments, the developing device 205Y according to the seventh embodiment includes the developing device main unit 2050 and the toner container (developer container). The developing device main unit 2050 includes, for example, the developing roller 2051 (developer supporting body); the supply roller 2053 (developer supply member); the doctor blade 2052 (developer regulating member); the plural conveyance screws 2054 and 2055 (conveyors); the partition member 2056; and the main unit side supply port 2057. Further, the toner container 2060 includes, for example, the agitator 2061; the container side conveyance screw 2062 (container side conveyor); and the container side supply port 2063. Similar to the case of the fifth embodiment, during a normal operation, the developing device main unit 2050 and the toner container 2060 of the developing device 205Y are attached to the image forming device main body 2100 as shown in FIGS. 14 and 15, and the image forming process is performed.

Referring to FIG. 21, the developing device main unit 2050 in the seventh embodiment includes the main unit side opening 2058 that is formed to be openable and closeable and disposed at an end portion in the longitudinal direction in the circulation paths B1 and B2. The main unit side opening 2058 opens downward. During a normal operation where the developing device 205Y is attached to the image forming device main body 2100 (an operation other than the toner collecting operation), the main unit side opening 2058 is covered (closed), for example, with a seal member or a shutter member. As shown in FIG. 21, when the toner remaining inside the developing device main unit 2050 removed from the image forming device main body 2100 is collected (during collection of the toner), the main unit side opening 2058 is opened so that the main unit side opening 2058 communicates with the container side supply port 2063, and the developing device main unit 2050 is attached (set) to the toner container 2060 so that the arrangement of the circulation paths B1 and B2 in the horizontal direction is maintained. In this state, the two conveyance screws 2054 and 2055 are rotational driven in the normal directions, similar to the case where the developing device 205Y is attached to the image forming device main body 2100.

With this, the toner remaining inside the developing device main unit 2050 is discharged from the main unit side opening 2058, while being circulated in the direction indicated by the black arrows in FIG. 21, and the toner falls by its own weight and is collected inside the toner container 2060 through the container side supply port 2063. Such a toner collecting task is performed in a state where an amount the toner being circulated in the circulation paths B1 and B2 is small. Since the toner is discharged from the main unit side opening 2058 positioned at the end portion of the first conveyance path B1, while being circulated in the circulation paths B1 and B2, by rotationally driving the two conveyance screws 2054 and 2055 similar to the case of the normal operation, the toner remaining inside the developing device main unit 2050 can be discharged while leaving almost no quantities of the toner in the developing device main unit 2050.

Further, when such a toner collecting task is performed, it is preferable that, in the toner container 2060, the container side conveyance screw 2062 is rotationally driven in a rotational direction that is opposite to the rotational direction when the developing device 205Y is attached to the image forming device main body 2100. In the seventh embodiment, during the collection of the toner, the toner container 2060, is reversed in the vertical direction with respect to the arrangement of the toner container 2060 in the case where the developing device 205Y is attached to the image forming device main body 2100, so that the container side supply port 2063 of the toner container 2060 opens upward. In order to present the toner from leaking from the container side supply port 2063, the toner is conveyed in the direction in which the toner is separated from the container side supply port 2063 by rotationally driving the container side conveyance screw 2062 in the opposite direction, and thereby ensuring that the toner is collected inside the housing unit C of the toner container 2060. According to the toner collecting method of the seventh embodiment, the developing device main unit 2050 and the toner container 2060 are arranged in parallel in the longitudinal direction. Therefore, it is possible to prevent the special tool for setting the developing device 2050 and the toner container 2060 from being enlarged in the vertical direction.

Further, as shown in FIG. 22, the openable and closable container side opening 2064 may be formed at an end portion in the longitudinal direction in the toner container 2060 according to the seventh embodiment. During the collection of the toner, the container side opening 2064 may be communicated with the main unit side opening 2058. During the normal operation in which the developing device 205Y is attached to the image forming device main body 2100 (an operation other than the toner collecting operation), the container side opening 2064 is covered (closed), for example, with a seal member or a shutter member. When the toner remaining inside the developing device main unit 2050 removed from the image forming device main body 2100 is collected, the main unit side opening 2058 and the container side opening 2064, which are closed when the developing device 205Y is attached to the device main body, are opened and the main unit side opening 2058 and the container side opening 2064 are communicated with each other. At this time, the developing device main unit 2050 is attached to the toner container 2060 so as to maintain the arrangement of the circulation paths B1 and B2 in the horizontal direction. Then, the plural conveyance screws 2054 and 2055 are rotationally driven in directions that are the same directions for the normal operation, and the container side conveyance screw 2062 is rotationally driven in a direction that is opposite to the direction for the normal operation. In such a case, during the collection of the toner, the toner container 2060 is attached to the developing device main unit 2050, while the toner container 2060 is reversed in the vertical direction with respect to the arrangement of the toner container 2060 in the case where the developing device 205Y is attached to the image forming device main body 2100. As described, since the container side supply port 2063 opens upward, the toner does not leak from the container side supply port 2063 during the collection of the toner, even if the container side supply port 2063 is not sealed by a sealing member.

As described above, in the seventh embodiment, similar to the case of the fifth embodiment, the plural conveyance screws 2054 and 2055 (conveyors), which convey the toner (developer) in the longitudinal direction and form the circulation path, are arranged in parallel in the vertical direction through the partition member 2056 in the developing device main unit 2050. When the developer remaining inside the developing device main unit 2050 removed from the image forming device main body 2100 is collected, the toner container 2060 (developer container) is attached to the developing device main unit 2050 in an arrangement that is different from the arrangement in the case where the developing device 205Y is attached to the image forming device main body 2100, and the toner is discharged from the developing device main unit 2050 and collected inside the toner container 2060 by driving the plural conveyance screws 2054 and 2055. In this manner, the toner remaining inside the developing device 205Y is cleanly collected, and the toner collected from the developing device 205Y can be reused without discarding it.

Additionally, in the seventh embodiment, during the collection of the toner, the developing device main unit 2050 is connected (attached) to the toner container 2060, while the arrangement in the vertical direction and in the horizontal direction is maintained to be the same as that of during the normal operation (when the developing device 205Y is attached to the image forming device main body 2100). In contrast, during the collection of the toner, the developing device main unit 2050 may be connected (attached) to the toner container 2060, while the developing device main unit 2050 is reversed in the vertical direction (the arrangement in the horizontal direction is maintained) with respect to the arrangement in the case of the normal operation (when the developing device 205Y is attached to the image forming device main body 2100). In such a case, the main unit side supply port 2057 or the main unit side opening 2058 (which is to be formed at the side of the second conveyance path B2) may be utilized for discharging the toner from the developing device main unit 2050.

Eighth Embodiment

Figure 23B:
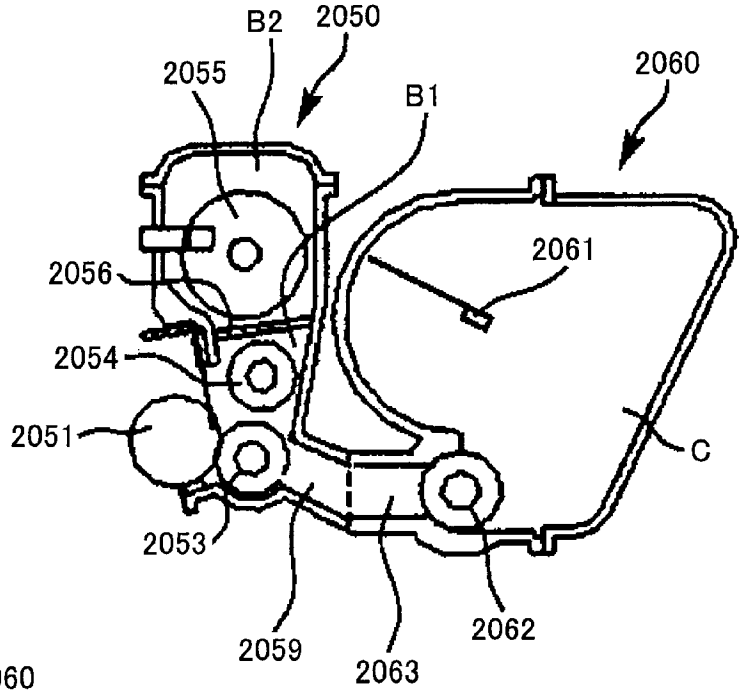
FIG. 23B is a diagram showing an X2-X2 cross-section in FIG. 23A.
Figure 23A:
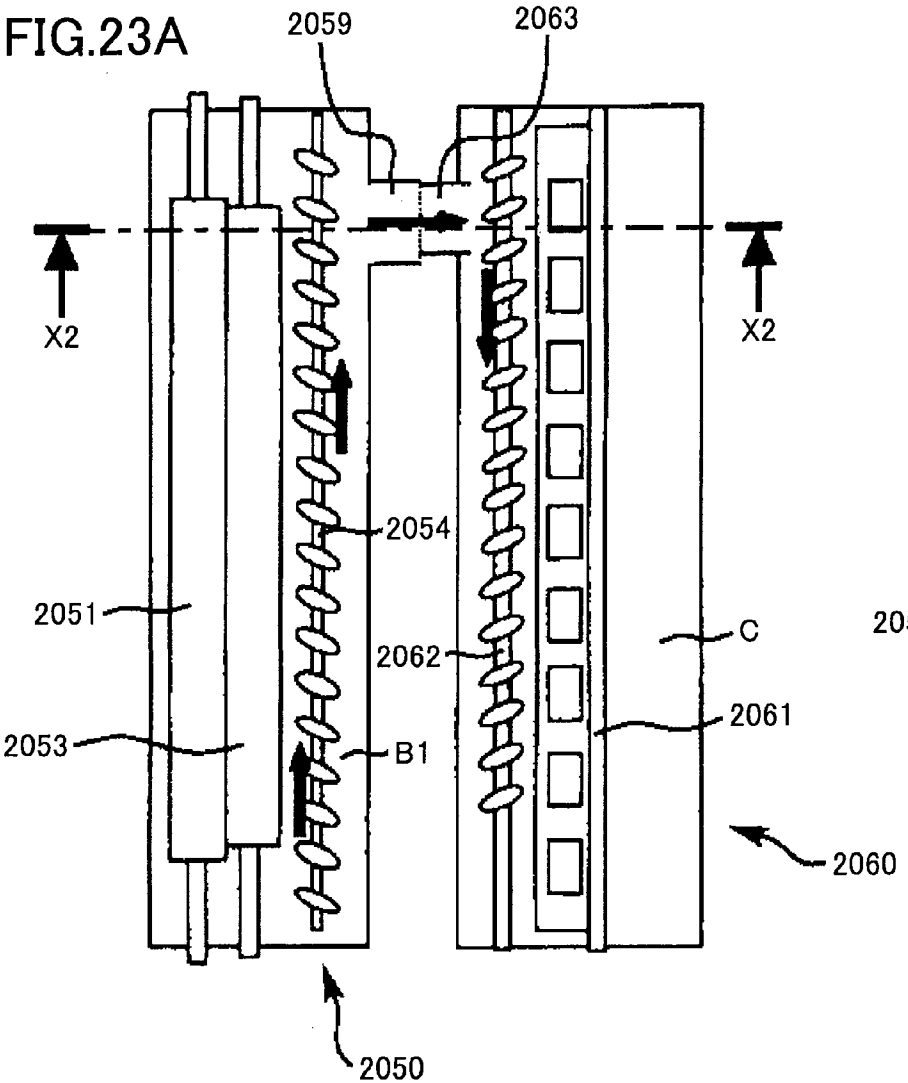
FIG. 23A is a cross-sectional view of a developing device during collection of developer according to an eighth embodiment.

Referring to FIGS. 23A and 23B, an eighth embodiment of the present invention is explained in detail. FIG. 23A is a schematic cross-sectional view showing the developing device according to the eighth embodiment in the longitudinal direction during collection of developer. FIG. 23A shows the developing device so that a connected state between the developing device main body 2050 and the toner container 2060 can be seen. FIG. 23B is a diagram showing the X2-X2 cross-section in FIG. 23A. The developer collecting method according to the eighth embodiment is different from that of the fifth embodiment in the point that the developer is collected from the developing device main unit 2050 to the developer container 2060 by using the main unit side opening 2059 formed at a lower portion of the developing device main unit 2050.

Similar to the fifth, sixth, and seventh embodiments, the developing device 205Y according to the eighth embodiment includes the developing device main unit 2050 and the toner container (developer container). The developing device main unit 2050 includes, for example, the developing roller 2051 (developer supporting body); the supply roller 2053 (developer supply member); the doctor blade 2052 (developer regulating member); the plural conveyance screws 2054 and 2055 (conveyors); the partition member 2056; and the main unit side supply port 2057. Further, the toner container 2060 includes, for example, the agitator 2061; the container side conveyance screw 2062 (container side conveyor); and the container side supply port 2063. Similar to the case of the fifth embodiment, during a normal operation, the developing device main unit 2050 and the toner container 2060 of the developing device 205Y are attached to the image forming device main body 2100 as shown in FIGS. 14 and 15, and the image forming process is performed.

Referring to FIGS. 23A and 23B, the developing device main unit 2050 in the eighth embodiment includes a main unit side opening 2059 that is formed to be openable and closeable and disposed at an end portion in the longitudinal direction in the circulating paths B1 and B2. The main unit side opening 2059 is disposed at a lower position of the developing device main unit 2050 when the developing device 205Y is attached to the image forming device main body 2100 (at a rear wall portion of the developing device main unit 2050 that faces the supply roller 2053). During a normal operation where the developing device 205Y is attached to the image forming device main body 2100 (an operation other than the toner collecting operation), the main unit side opening 2059 is covered (closed), for example, with a seal member or a shutter member. As shown in FIGS. 23A and 23B, when the toner remaining inside the developing device main unit 2050 removed from the image forming device main body 2100 is collected (during collection of the toner), the main unit side opening 2059 is opened so that the main unit side opening 2059 communicates with the container side supply port 2063, and the developing device main unit 2050 is attached (set) to the toner container 2060 so that the arrangement of the circulation paths B1 and B2 in the vertical direction and in the horizontal direction is maintained. In this state, the two conveyance screws 2054 and 2055 are rotational driven in the normal directions, similar to the case where the developing device 205Y is attached to the image forming device main body 2100.

With this, the toner remaining inside the developing device main unit 2050 is discharged from the main unit side opening 2059, while being circulated in the circulation paths B1 and B2, and the toner is collected inside the toner container 2060 through the container side supply port 2063. Such a toner collecting task is performed in a state where an amount the toner being circulated in the circulation paths B1 and B2 is small. Since the toner is discharged from the main unit side opening 2059 positioned at the lower portion of the first conveyance path B1, while being circulated in the circulation paths B1 and B2, by rotationally driving the two conveyance screws 2054 and 2055 similar to the case of the normal operation, the toner remaining inside the developing, device main unit 2050 can be discharged while leaving almost no quantities of the toner in the developing device main unit 2050.

Further, when such a toner collecting task is performed, in the toner container 2060, the container side conveyance screw 2062 is rotationally driven in a direction that is opposite to the direction in the case where the developing device 205Y is attached to the image forming device main body 2100. In the eighth embodiment, during the collection of the toner, the toner container 2060 is attached to the developing device main unit 2050, while the toner container 2060 is rotated by 90 degrees with respect to the arrangement of the toner container 2060 in the case where the developing device 205Y is attached to the image forming device main body 2100, so that container side supply port 2063 of the toner container 2060 opens in the horizontal direction. In order to prevent the toner from being flowed back from the container side supply port 2063 to the developing device main unit 2050, the toner is conveyed in the direction in which the toner is separated from the container side supply port 2063 by rotationally driving the container side conveyance screw 2062 in the opposite direction, and thereby ensuring that the toner is stored in the housing unit C of the toner container 2060. According to the toner collecting method of the eighth embodiment, the developing device main unit 2050 and the toner container 2060 are arranged in parallel in the short direction. Therefore, it is possible to prevent the special tool for setting the developing device 2050 and the toner container 2060 from being enlarged in the vertical direction.

As described above, in the eighth embodiment, similar to the case of the fifth through seventh embodiments, the plural conveyance screws 2054 and 2055 (conveyors), which convey the toner (developer) in the longitudinal direction and form the circulation path, are arranged in parallel in the vertical direction through the partition member 2056 in the developing device main unit 2050. When the developer remaining inside the developing device main unit 2050 removed from the image forming device main body 2100 is collected, the toner container 2060 (developer container) is attached to the developing device main unit 2050 in an arrangement that is different from the arrangement when the developing device 205Y is attached to the image forming device main body 2100, and the toner is discharged from the developing device main unit 2050 and collected inside the toner container 2060 by driving the plural conveyance screws 2054 and 2055. In this manner, the toner remaining inside the developing device 205Y is cleanly collected, and the toner collected from the developing device 205Y can be reused without discarding it.

The fifth through eighth embodiments are directed to the method of collecting the developer (toner) from the developing device 205Y of the single component developing method where the toner (single component developer) is utilized as the developer. However, the embodiments are not limited to this, and the embodiments of the present invention may be applied to a method of collecting developer (two component developer) from the developing device 205Y of the two component developing method where the two component developer including toner and carrier is utilized as the developer. In such a case, the developer container 2060 stores the two component developer, and the two component developer is supplied from the developer container 2060 to the developing device main unit 2050. Further, a developer discharging unit that appropriately discharges surplus toner from the developing device main body may be included in the developing device 205Y. In such a case, the effect that is similar to those of the embodiments can be obtained.

Further, the fifth through eighth embodiments are directed to the case where the developing device main unit 2050 is formed as a single unit that can be detachably attached to the image forming device main body 2100. However, the embodiments are not limited to this, and the embodiments may be directed to a case where the developing device main unit 2050 is integrally formed with at least one of the photosensitive drum 201Y (image supporting body), the charging unit 204Y, and the cleaning unit 202Y as a unit (process unit). In such a case, the developing device main unit 2050 is removed from the image forming device main body 2100 together with the other integrally formed member, and the toner collecting task is performed in a state where the toner container 2060 is attached to the developing device main body 2050, similar to the cases of the embodiments. Additionally, in such a case, the effect similar to those of the embodiments can be obtained by performing the developer collecting method in a manner that is similar to those of the embodiments.

Further, the fifth through eighth embodiments are directed to the developing device 205Y in which the two conveyance screws 2054 and 2055 (conveyors) are arranged in parallel in the vertical direction. However, the embodiments are not limited to this, and the embodiments of the present invention can be applied to a developing device in which three or more conveyance screws are arranged in parallel in the vertical direction and thereby forming a circulation path. In such a case, the effect similar to those of the embodiments can be obtained by performing the developer collecting method in a manner that is similar to those of the embodiments.

(1) According to the embodiments, a developer collecting method is for a developing device configured to be detachably attached to an image forming device main body. The developing device includes a developing device main unit configured to develop a latent image formed on an image supporting body; and a developer container configured to be detachably attached to an upper portion of the developing device main unit attached to the image forming device main body, wherein the developer container is configured to store developer to be supplied to the developing device main unit. The developing device main unit includes a developer supporting body disposed to face the image supporting body in a state in which the developing device main unit is attached to the image forming device main body and configured to support the developer; plural conveyors configured to convey the developer stored inside the image forming device main unit in a longitudinal direction and configured to form a circulation path in the state in which the developing device main unit is attached to the image forming device main body, the plural conveyors being arranged in parallel in a vertical direction through a partition member; and a main unit side supply port configured to communicate with a container side supply port of the developer container at an upper portion of the developing device main unit in the state in which the developing device main unit is attached to the image forming device main body, wherein the main unit side supply port is configured to supply the developer from the developer container to the developing device main unit. In the developer collecting method, when the developer remaining inside the developing device main unit being removed from the image forming device main body is collected, the developing device main unit is attached to the developer container in a first arrangement that is different from a second arrangement of the developing device main unit and the developer container in a state in which the developing device main unit and the developer container are attached to the image forming device main body, and the developer is discharged from the developing device main body and collected inside the developer container by driving the plural conveyors similar to a case where the developing device main unit is attached to the image forming device main body.

(2) In the developer collecting method described in (1), when the developer remaining inside the developing device main unit being removed from the image forming device main body is collected, the developer container may be attached to the developing device main unit so that the container side supply port and the main unit side supply port are communicated with each other in the first arrangement where a first position of the developing device main unit and a second position of the developer container are reversed in the vertical direction with respect to the first position of the developing device main unit and the second position of the developer container in the second arrangement, and the plural conveyors may be driven similar to the case where the developing device main unit is attached to the image forming device main body.

(3) In the developer collecting method described in (1), the developing device main unit may include a main unit side opening disposed at an end portion of the circulation path in the longitudinal direction and configured to be openable and closable. In this case, in the developer collecting method, when the toner remaining inside the developing device main unit being removed from the image forming device main body is collected, the developing device main unit may be attached to the developer container by opening the main unit side opening, so that the main unit side opening and the container side supply port are communicated with each other and an arrangement of the circulation path in a horizontal direction is maintained, wherein the main unit side opening is closed when the developing device main unit is attached to the image forming device main body, and the plural conveyors may be driven similar to the case where the developing device main unit is attached to the image forming device main body.

(4) In the developer collecting method described in (1), the developing device main unit may include a main unit side opening disposed at an end portion of the circulation path in the longitudinal direction and configured to be openable and closable. The developer container may include a container side opening disposed at an end portion of the developer container in the longitudinal direction and configured to be openable and closable. In the developer collecting method, when the toner remaining inside the developing device main unit being removed from the image forming device main body is collected, the developing device main unit may be attached to the developer container by opening the main unit side opening and the container side opening, so that the main body side opening and the container side opening are communicated with each other and an arrangement of the circulation path in a horizontal direction is maintained, wherein the main unit side opening and the container side opening are closed when the developing device main unit is attached to the image forming device main body, and the plural conveyors may be driven similar to the case where the developing device main unit is attached to the image forming device main body.

(5) In the developer collecting method described in (3) or (4), when the toner remaining inside the developing device main unit being removed from the image forming device main body is collected, the developer container may be attached to the developing device main unit in a state in which the longitudinal direction of the developer container is set to the vertical direction, and the developer discharged from the developing device main unit may fall by a weight of the developer and be collected in the developer container.

(6) In the developer collecting method described in any of (2) through (4), the container side supply port may be disposed at an end portion of the developer container in the longitudinal direction of the developer container, and the developer container may include a container side conveyor configured to convey the developer stored inside the developer container toward the container side supply port in the longitudinal direction, when the developer container is attached to the image forming unit main body. In the developer collecting method, when the developer remaining inside the developing device main body being removed from the image forming device main body is collected, the container side conveyor may be rotationally driven in a first direction that is opposite to a second direction in which the container side conveyor is rotationally driven when the developer container is attached to the image forming unit main body.

(7) In the developer collecting method according to any of (2) through (4), the container side supply port may be disposed at an end portion of the developer container in the longitudinal direction of the developer container, and the developer container may include plural container side conveyors configured to convey the developer stored inside the developer container toward the container side supply port, while the plural container side conveyors circulate the toner in the longitudinal direction, when the developer container is attached to the image forming unit main body. In the developer collecting method, when the developer remaining inside the developing device main unit being removed from the image forming device main body is collected, the container side conveyors may be rotationally driven.

In the developer collecting method described in (1), the developing device main unit may include a main unit side opening disposed at an end portion of the circulation path in the longitudinal direction and configured to be openable and closable, the main unit side opening being disposed at a lower position of the developing device main unit when the developing device main unit is attached to the image forming device main body. The container side supply port may be disposed at an end portion of the developer container, and the developer container may include a container side conveyor configured to convey the developer stored inside the developer container toward the container side supply port in the longitudinal direction, when the developer container is attached to the image forming unit main body. In the developer collecting method, when the developer remaining inside the developing device main unit being removed from the image forming device main body is collected, the developing device main unit may be attached to the developer container so that the main unit side opening and the container side opening are communicated with each other by opening the main unit side opening and an arrangement of the developing device main unit in the vertical direction and in the horizontal direction in a condition in which the developing device main unit is attached to the image forming device main body is maintained, wherein the main unit side opening is closed when the developing device main body is attached to the image forming device main body, and the plural conveyors may be driven similar to the case where the developing device main unit is attached to the image forming device main body, while the container side conveyor may be rotationally driven in a first direction that is opposite to a second direction in which the container side conveyor is rotationally driven when the developer container is attached to the image forming unit main body.

In the developer collecting method described in any of (1) through (8), the developer may be toner, and the developing device main unit may include a developer supply member configured to slidably contact the developer supporting body and configured to supply the developer to the developer supporting body, wherein the developer supply member is disposed below the plural conveyors when the developing device main unit is attached to the image forming device main body; and a developer regulating member configured to regulate an amount of the developer supported on the developer supporting body, wherein the developer regulating member is disposed to contact the developer supporting body when the developing device main unit is attached to the image forming device main body.

(10) In the developer collecting method described in any of (1) through (9), the developing device main unit may be integrally formed with at least one of the image supporting body, a charge unit configured to charge the image supporting body, and a cleaning unit configured to clean a surface of the image supporting body.

In the above, the developer container, the developing device, the process cartridge, the image forming device, and the developer refilling method have been explained by the embodiments. However, the present invention is not limited to the above-described embodiments, and various modifications and improvements may be made within the scope of the present invention. For example, the number, the shape, and the position of each of the components may be modified without departing from the scope of the present invention.

The present application is based on Japanese Priority Applications No. 2011-172608 filed on Aug. 8, 2011, and No. 2012-010244 filed on Jan. 20, 2012, the entire contents of which are hereby incorporated herein by reference.

The invention claimed is:

1. A developer collecting method of a developing device configured to be detachably attached to an image forming device main body, wherein the developing device includes a developing device main unit configured to develop a latent image formed on an image supporting body; and a developer container configured to be detachably attached to an upper portion of the developing device main unit attached to the image forming device main body, wherein the developer container is configured to store developer to be supplied to the developing device main unit, wherein the developing device main unit includes a developer supporting body disposed to face the image supporting body in a state in which the developing device main unit is attached to the image forming device main body and configured to support the developer;

plural conveyance members configured to convey the developer stored inside the developing device main unit in a longitudinal direction and configured to form a circulation path in the state in which the developing device main unit is attached to the image forming device main body, the plural conveyance members being arranged in parallel in a vertical direction through a partition member; and a main unit side supply port configured to communicate with a container side supply port of the developer container at an upper portion of the developing device main unit in the state in which the developing device main unit is attached to the image forming device main body, wherein the main unit side supply port is configured to supply the developer from the developer container to the developing device main unit, and the developer collecting method comprising:

when the developer remaining inside the developing device main unit being removed from the image forming device main body is collected, attaching the developing device main unit to the developer container in a first arrangement that is different from a second arrangement between the developing device main unit and the developer container in a state in which the developing device main unit and the developer container are attached to the image forming device main body; and discharging the developer from the developing device main body and collecting the developer inside the developer container by driving the plural conveyance members similar to a case where the developing device main unit is attached to the image forming device main body.

2. The developer collecting method according to claim 1, wherein, when the developer remaining inside the developing device main unit being removed from the image forming device main body is collected, the developer container is attached to the developing device main unit so that the container side supply port and the main unit side supply port are communicated with each other in the first arrangement where a first position of the developing device main unit and a second position of the developer container are reversed in the vertical direction with respect to the first position of the developing device main unit and the second position of the developer container in the second arrangement, and the plural conveyance members are driven similar to the case where the developing device main unit is attached to the image forming device main body.

3. The developer collecting method according to claim 2, wherein the container side supply port is disposed at an end portion of the developer container in the longitudinal direction of the developer container, and the developer container includes a container side conveyance member configured to convey the developer stored inside the developer container toward the container side supply port in the longitudinal direction, when the developer container is attached to the image forming unit main body, and wherein, when the developer remaining inside the developing device main body being removed from the image forming device main body is collected, the container side conveyance member is rotationally driven in a first direction that is opposite to a second direction in which the container side conveyance member is rotationally driven when the developer container is attached to the image forming unit main body.

4. The developer collecting method according to claim 2, wherein the container side supply port is disposed at an end portion of the developer container in the longitudinal direction of the developer container, and the developer container includes plural container side conveyance members configured to convey the developer stored inside the developer container toward the container side supply port, while the plural container side conveyance members circulates the toner in the longitudinal direction, when the developer container is attached to the image forming unit main body, and wherein, when the developer remaining inside the developing device main unit being removed from the image forming device main body is collected, the container side conveyance members are rotationally driven.

5. The developer collecting method according to claim 1, wherein the developing device main unit includes main unit side opening disposed at an end portion of the circulation path in the longitudinal direction and configured to be openable and closable, and wherein, when the toner remaining inside the developing device main unit being removed from the image forming device main body is collected, the developing device main unit is attached to the developer container by opening the main unit side opening, so that the main unit side opening and the container side supply port are communicated with each other and an arrangement of the circulation path in a horizontal direction is maintained, wherein the main unit side opening is closed when the developing device main unit is attached to the image forming device main body, and the plural conveyance members are driven similar to the case where the developing device main unit is attached to the image forming device main body.

6. The developer collecting method according to claim 5, wherein, when the toner remaining inside the developing device main unit being removed from the image forming device main body is collected, the developer container is attached to the developing device main unit, while the longitudinal direction of the developer container is set to the vertical direction, and the developer discharged from the developing device main unit is fallen by a weight of the developer and collected in the developer container.

7. The developer collecting method according to claim 6, wherein the container side supply port is disposed at an end portion of the developer container in the longitudinal direction of the developer container, and the developer container includes a container side conveyance member configured to convey the developer stored inside the developer container toward the container side supply port in the longitudinal direction, when the developer container is attached to the image forming unit main body, and wherein, when the developer remaining inside the developing device main body being removed from the image forming device main body is collected, the container side conveyance member is rotationally driven in a first direction that is opposite to a second direction in which the container side conveyance member is rotationally driven when the developer container is attached to the image forming unit main body.

8. The developer collecting method according to claim 7, wherein the container side supply port is disposed at an end portion of the developer container in the longitudinal direction of the developer container, and the developer container includes plural container side conveyance members configured to convey the developer stored inside the developer container toward the container side supply port, while the plural container side conveyance members circulates the toner in the longitudinal direction, when the developer container is attached to the image forming unit main body, and wherein, when the developer remaining inside the developing device main unit being removed from the image forming device main body is collected, the container side conveyance members are rotationally driven.

9. The developer collecting method according to claim 6, wherein the container side supply port is disposed at an end portion of the developer container in the longitudinal direction of the developer container, and the developer container includes plural container side conveyance members configured to convey the developer stored inside the developer container toward the container side supply port, while the plural container side conveyance members circulates the toner in the longitudinal direction, when the developer container is attached to the image forming unit main body, and wherein, when the developer remaining inside the developing device main unit being removed from the image forming device main body is collected, the container side conveyance members are rotationally driven.

10. The developer collecting method according to claim 5, wherein the container side supply port is disposed at an end portion of the developer container in the longitudinal direction of the developer container, and the developer container includes a container side conveyance member configured to convey the developer stored inside the developer container toward the container side supply port in the longitudinal direction, when the developer container is attached to the image forming unit main body, and wherein, when the developer remaining inside the developing device main body being removed from the image forming device main body is collected, the container side conveyance member is rotationally driven in a first direction that is opposite to a second direction in which the container side conveyance member is rotationally driven when the developer container is attached to the image forming unit main body.

11. The developer collecting method according to claim 10, wherein the container side supply port is disposed at an end portion of the developer container in the longitudinal direction of the developer container, and the developer container includes plural container side conveyance members configured to convey the developer stored inside the developer container toward the container side supply port, while the plural container side conveyance members circulates the toner in the longitudinal direction, when the developer container is attached to the image forming unit main body, and wherein, when the developer remaining inside the developing device main unit being removed from the image forming device main body is collected, the container side conveyance members are rotationally driven.

12. The developer collecting method according to claim 1, wherein the developing device main unit includes main unit side opening disposed at an end portion of the circulation path in the longitudinal direction and configured to be openable and closable, wherein the developer container includes a container side opening disposed at an end portion of the developer container in the longitudinal direction and configured to be openable and closable, and wherein, when the toner remaining inside the developing device main unit being removed from the image forming device main body is collected, the developing device main unit is attached to the developer container by opening the main unit side opening and the container side opening, so that the main body side opening and the container side opening are communicated with each other and an arrangement of the circulation path in a horizontal direction is maintained, wherein the main unit side opening and the container side opening are closed when the developing device main unit is attached to the image forming device main body, and the plural conveyance members are driven similar to the case where the developing device main unit is attached to the image forming device main body.

13. The developer collecting method according to claim 12, wherein, when the toner remaining inside the developing device main unit being removed from the image forming device main body is collected, the developer container is attached to the developing device main unit, while the longitudinal direction of the developer container is set to the vertical direction, and the developer discharged from the developing device main unit is fallen by a weight of the developer and collected in the developer container.

14. The developer collecting method according to claim 13, wherein the container side supply port is disposed at an end portion of the developer container in the longitudinal direction of the developer container, and the developer container includes a container side conveyance member configured to convey the developer stored inside the developer container toward the container side supply port in the longitudinal direction, when the developer container is attached to the image forming unit main body, and wherein, when the developer remaining inside the developing device main body being removed from the image forming device main body is collected, the container side conveyance member is rotationally driven in a first direction that is opposite to a second direction in which the container side conveyance member is rotationally driven when the developer container is attached to the image forming unit main body.

15. The developer collecting method according to claim 14, wherein the container side supply port is disposed at an end portion of the developer container in the longitudinal direction of the developer container, and the developer container includes plural container side conveyance members configured to convey the developer stored inside the developer container toward the container side supply port, while the plural container side conveyance members circulates the toner in the longitudinal direction, when the developer container is attached to the image forming unit main body, and wherein, when the developer remaining inside the developing device main unit being removed from the image forming device main body is collected, the container side conveyance members are rotationally driven.

16. The developer collecting method according to claim 14, wherein the container side supply port is disposed at an end portion of the developer container in the longitudinal direction of the developer container, and the developer container includes plural container side conveyance members configured to convey the developer stored inside the developer container toward the container side supply port, while the plural container side conveyance members circulates the toner in the longitudinal direction, when the developer container is attached to the image forming unit main body, and wherein, when the developer remaining inside the developing device main unit being removed from the image forming device main body is collected, the container side conveyance members are rotationally driven.

17. The developer collecting method according to claim 12, wherein the container side supply port is disposed at an end portion of the developer container in the longitudinal direction of the developer container, and the developer container includes a container side conveyance member configured to convey the developer stored inside the developer container toward the container side supply port in the longitudinal direction, when the developer container is attached to the image forming unit main body, and wherein, when the developer remaining inside the developing device main body being removed from the image forming device main body is collected, the container side conveyance member is rotationally driven in a first direction that is opposite to a second direction in which the container side conveyance member is rotationally driven when the developer container is attached to the image forming unit main body.

18. The developer collecting method according to claim 17, wherein the container side supply port is disposed at an end portion of the developer container in the longitudinal direction of the developer container, and the developer container includes plural container side conveyance members configured to convey the developer stored inside the developer container toward the container side supply port, while the plural container side conveyance members circulates the toner in the longitudinal direction, when the developer container is attached to the image forming unit main body, and wherein, when the developer remaining inside the developing device main unit being removed from the image forming device main body is collected, the container side conveyance members are rotationally driven.

19. The developer collecting method according to claim 1, wherein the developing device main unit includes a main unit side opening disposed at an end portion of the circulation path in the longitudinal direction and configured to be openable and closable, the main unit side opening being disposed at a lower position of the developing device main unit when the developing device main unit is attached to the image forming device main body, wherein the container side supply port is disposed at an end portion of the developer container, and the developer container includes a container side conveyance member configured to convey the developer stored inside the developer container toward the container side supply port in the longitudinal direction, when the developer container is attached to the image forming unit main body, and wherein, when the developer remaining inside the developing device main unit being removed from the image forming device main body is collected, the developing device main unit is attached to the developer container so that the main unit side opening and the container side opening are communicated with each other by opening the main unit side opening and an arrangement of the developing device main unit in the vertical direction and in the horizontal direction in a condition in which the developing device main unit is attached to the image forming device main body is maintained, wherein the main unit side opening is closed when the developing device main body is attached to the image forming device main body, and the plural conveyance members are driven similar to the case where the developing device main unit is attached to the image forming device main body, and the container side conveyance member is rotationally driven in a first direction that is opposite to a second direction in which the container side conveyance member is rotationally driven when the developer container is attached to the image forming unit main body.

20. The developer collecting method according to claim 1, wherein the developer is toner, and wherein the developing device main unit includes a developer supply member configured to slidably contact the developer supporting body and configured to supply the developer to the developer supporting body, wherein the developer supply member is disposed below the plural conveyance members when the developing device main unit is attached to the image forming device main body; and a developer regulating member configured to regulate an amount of the developer supported on the developer supporting body, wherein the developer regulating member is disposed to contact the developer supporting body when the developing device main unit is attached to the image forming device main body.

* * * * *